US010227543B2

(12) United States Patent
Abe et al.

(10) Patent No.: US 10,227,543 B2
(45) Date of Patent: Mar. 12, 2019

(54) LUBRICANT COMPOSITIONS

(71) Applicant: MITSUI CHEMICALS, INC., Tokyo (JP)

(72) Inventors: Shota Abe, Chiba (JP); Ryousuke Kaneshige, Kisarazu (JP)

(73) Assignee: MITSUI CHEMICALS, INC., Tokyo (JP)

( * ) Notice: Subject to any disclaimer, the term of this patent is extended or adjusted under 35 U.S.C. 154(b) by 194 days.

(21) Appl. No.: 15/508,697

(22) PCT Filed: Sep. 7, 2015

(86) PCT No.: PCT/JP2015/075338
§ 371 (c)(1),
(2) Date: Mar. 3, 2017

(87) PCT Pub. No.: WO2016/039295
PCT Pub. Date: Mar. 17, 2016

(65) Prior Publication Data

US 2017/0253827 A1 Sep. 7, 2017

(30) Foreign Application Priority Data

Sep. 10, 2014 (JP) ..... 2014-184149

(51) Int. Cl.
*C10M 143/04* (2006.01)
*C10M 169/04* (2006.01)
*C10M 107/06* (2006.01)

(52) U.S. Cl.
CPC ..... *C10M 143/04* (2013.01); *C10M 107/06* (2013.01); *C10M 169/041* (2013.01);
(Continued)

(58) Field of Classification Search
CPC ..... C10M 143/04; C10M 169/041; C10M 107/06; C10M 2205/024;
(Continued)

(56) References Cited

U.S. PATENT DOCUMENTS 3,780,128 A 12/1973 Shubkin
3,909,432 A 9/1975 McGuire et al.
(Continued)

FOREIGN PATENT DOCUMENTS

EP 0 291 006 A2 11/1988
EP 0 291 006 A3 11/1988
(Continued)

OTHER PUBLICATIONS

US 5,168,111, 12/1992, Canich (withdrawn)
(Continued)

*Primary Examiner* — Pamela H Weiss
(74) *Attorney, Agent, or Firm* — Foley & Lardner LLP

(57) ABSTRACT

A lubricant composition includes a lubricant base oil (A) having a kinematic viscosity at 100° C. of 1 to 10 $mm^2/s$, and an ethylene/α-olefin copolymer (B) in which (B1) the peak top molecular weight is 3,000 to 10,000, (B2) the copolymer shows no melting peak, (B3) the value B is not less than 1.1 and (B4) the kinematic viscosity at 100° C. is 140 to 500 $mm^2/s$. The lubricant composition has a kinematic viscosity at 100° C. of not more than 20 $mm^2/s$, a peak top of molecular weight in the range of 3,000 to 10,000, and a weight fraction of components having a molecular weight not less than 20,000 of 1 to 10% relative to all components having a molecular weight not less than the molecular weight that gives the peak top.

4 Claims, 1 Drawing Sheet

(52) U.S. Cl.
CPC ..... *C10M 2203/1025* (2013.01); *C10M 2205/022* (2013.01); *C10M 2205/024* (2013.01); *C10M 2205/0285* (2013.01); *C10M 2207/2825* (2013.01); *C10N 2220/021* (2013.01); *C10N 2220/022* (2013.01); *C10N 2220/033* (2013.01); *C10N 2230/02* (2013.01); *C10N 2230/54* (2013.01); *C10N 2230/68* (2013.01); *C10N 2240/04* (2013.01); *C10N 2240/042* (2013.01); *C10N 2240/044* (2013.01); *C10N 2240/045* (2013.01)

(58) Field of Classification Search
CPC .. C10M 2207/2825; C10M 2205/0285; C10M 2205/022; C10M 2203/1025; C10N 2230/54; C10N 2240/045; C10N 2240/044; C10N 2240/042; C10N 2240/04; C10N 2230/68; C10N 2230/02; C10N 2220/033; C10N 2220/022; C10N 2220/021
See application file for complete search history.

(56) References Cited

U.S. PATENT DOCUMENTS 4,032,591 A 6/1977 Cupples et al.
4,668,834 A 5/1987 Rim et al.
4,704,491 A * 11/1987 Tsutsui ..... C08F 8/04 526/160
4,853,139 A 8/1989 Ichihashi
4,874,880 A 10/1989 Miya et al.
4,892,851 A 1/1990 Ewen et al.
4,908,411 A 3/1990 Kinoshita et al.
4,956,512 A 9/1990 Nissfolk et al.
4,960,878 A 10/1990 Crapo et al.
4,990,640 A 2/1991 Tsutsui et al.
5,026,798 A 6/1991 Canich
5,041,584 A 8/1991 Crapo et al.
5,055,438 A 10/1991 Canich
5,057,475 A 10/1991 Canich et al.
5,093,418 A 3/1992 Kinoshita et al.
5,096,867 A 3/1992 Canich
5,153,157 A 10/1992 Hlatky et al.
5,155,080 A 10/1992 Elder et al.
5,158,920 A 10/1992 Razavi
5,162,278 A 11/1992 Razavi
5,195,401 A 3/1993 Mouton
5,223,467 A 6/1993 Razavi
5,223,468 A 6/1993 Razavi
5,225,500 A 7/1993 Elder et al.
5,227,440 A 7/1993 Canich et al.
5,241,025 A 8/1993 Hlatky et al.
5,243,002 A 9/1993 Razavi
5,264,405 A 11/1993 Canich
5,278,119 A 1/1994 Turner et al.
5,278,265 A 1/1994 Razavi
5,292,838 A 3/1994 Razavi
5,304,523 A 4/1994 Razavi
5,321,106 A 6/1994 Lapointe
5,334,677 A 8/1994 Razavi et al.
5,384,299 A 1/1995 Turner et al.
5,387,568 A 2/1995 Ewen et al.
5,391,629 A 2/1995 Turner et al.
5,407,884 A 4/1995 Turner et al.
5,408,017 A 4/1995 Turner et al.
5,420,217 A 5/1995 Canich
5,470,927 A 11/1995 Turner et al.
5,483,014 A 1/1996 Turner et al.
5,504,169 A 4/1996 Canich
5,519,100 A 5/1996 Ewen et al.
5,547,675 A 8/1996 Canich
5,561,092 A 10/1996 Ewen et al.
5,589,556 A 12/1996 Razavi
5,599,761 A 2/1997 Turner
5,614,457 A 3/1997 Ewen et al.
5,621,126 A 4/1997 Canich et al.
5,631,391 A 5/1997 Canich
5,663,249 A 9/1997 Ewen et al.
5,723,560 A 3/1998 Canich
5,763,549 A 6/1998 Elder et al.
5,767,331 A 6/1998 Oda et al.
5,801,113 A 9/1998 Jejelowo et al.
5,807,939 A 9/1998 Elder et al.
5,883,202 A 3/1999 Ewen et al.
5,955,639 A 9/1999 Oda et al.
6,008,164 A 12/1999 Aldrich et al.
6,059,955 A 5/2000 Cody et al.
6,080,301 A 6/2000 Berlowitz et al.
6,090,989 A 7/2000 Trewella et al.
6,096,940 A 8/2000 Wittenbrink et al.
6,103,099 A 8/2000 Wittenbrink et al.
6,121,395 A 9/2000 Turner
6,153,807 A 11/2000 Oda et al.
6,165,949 A 12/2000 Berlowitz et al.
6,232,420 B1 5/2001 Turner
6,245,706 B1 6/2001 Hlatky
6,265,338 B1 7/2001 Canich
6,294,625 B1 9/2001 Hlatky et al.
6,332,974 B1 12/2001 Wittenbrink et al.
6,355,592 B1 3/2002 Hlatky et al.
6,417,120 B1 7/2002 Mitchler et al.
6,420,618 B1 7/2002 Berlowitz et al.
6,423,795 B1 7/2002 Canich et al.
6,459,005 B1 10/2002 Hirano et al.
6,475,960 B1 11/2002 Berlowitz et al.
6,506,297 B1 1/2003 Wittenbrink et al.
6,599,864 B1 7/2003 Bertomeu
6,617,466 B1 9/2003 Canich
6,632,898 B1 10/2003 Canich
6,858,767 B1 2/2005 Dimaio et al.
7,041,841 B1 5/2006 Canich
7,163,907 B1 1/2007 Canich et al.
7,569,646 B1 8/2009 Canich
7,795,366 B2 * 9/2010 Yang ..... C08K 5/01 526/348
2002/0010290 A1 1/2002 Minami et al.
2002/0086803 A1 7/2002 Berlowitz et al.
2002/0143113 A1 10/2002 Minami et al.
2002/0155776 A1 10/2002 Mitchler et al.
2003/0013623 A1 1/2003 Tse et al.
2006/0025316 A1 2/2006 Covitch et al.
2006/0025640 A1 * 2/2006 Karjala ..... C08F 210/16 585/17
2006/0178491 A1 8/2006 Canich
2007/0043248 A1 2/2007 Wu et al.
2008/0125561 A1 * 5/2008 Matsuda ..... C08F 10/00 526/348
2008/0177121 A1 7/2008 Wu et al.
2009/0005279 A1 1/2009 Wu et al.
2010/0256427 A1 * 10/2010 Karjala ..... C08F 210/16 585/18
2010/0292424 A1 11/2010 Wu et al.
2010/0311624 A1 12/2010 Covitch et al.
2012/0135903 A1 5/2012 Abe et al.
2013/0158307 A1 6/2013 Wu et al.
2013/0245343 A1 9/2013 Emett et al.
2013/0317166 A1 11/2013 Kanamaru et al.
2014/0378720 A1 12/2014 Wu et al.
2015/0252279 A1 9/2015 Wu et al.

FOREIGN PATENT DOCUMENTS

EP 0 668 342 A1 8/1995
EP 0 776 959 A2 6/1997
EP 1 029 029 B1 6/2013
JP S57-117595 A 7/1982
JP S61-126120 A 6/1986
JP S61-221207 A 10/1986
JP S62-121710 A 6/1987
JP H01-163136 A 6/1989
JP H01-501950 A 7/1989
JP H01-502036 A 7/1989

(56) References Cited

FOREIGN PATENT DOCUMENTS

| | | | |
|---|---|---|---|
| JP | H02-001163 | B2 | 1/1990 |
| JP | H02-024701 | A | 1/1990 |
| JP | H02-007998 | B2 | 2/1990 |
| JP | H02-078687 | A | 3/1990 |
| JP | H02-167305 | A | 6/1990 |
| JP | H03-103407 | A | 4/1991 |
| JP | H03-179005 | A | 8/1991 |
| JP | H03-179006 | A | 8/1991 |
| JP | H03-207703 | A | 9/1991 |
| JP | H03-207704 | A | 9/1991 |
| JP | H06-062642 | B2 | 8/1994 |
| JP | H07-121969 | B2 | 12/1995 |
| JP | 2593264 | B2 | 3/1997 |
| JP | 2796376 | B2 | 9/1998 |
| JP | 2000-351813 | A | 12/2000 |
| JP | 2001-335607 | A | 12/2001 |
| JP | 2002-356692 | A | 12/2002 |
| JP | 2004-051676 | A | 2/2004 |
| JP | 2004-506758 | A | 3/2004 |
| JP | 2008-508402 | A | 3/2008 |
| JP | 2009-503147 | A | 1/2009 |
| JP | 2009-514991 | A | 4/2009 |
| WO | WO-97/21788 | A1 | 6/1997 |
| WO | WO-99/41332 | A1 | 8/1999 |
| WO | WO-00/08115 | A1 | 2/2000 |
| WO | WO-00/14179 | A1 | 3/2000 |
| WO | WO-00/14183 | A1 | 3/2000 |
| WO | WO-00/14187 | A2 | 3/2000 |
| WO | WO-00/14188 | A2 | 3/2000 |
| WO | WO-00/15736 | A2 | 3/2000 |
| WO | WO-01/18156 | A1 | 3/2001 |
| WO | WO-01/57166 | A1 | 8/2001 |
| WO | WO-2011/142345 | A1 | 11/2011 |
| WO | WO-2012/070240 | A1 | 5/2012 |

OTHER PUBLICATIONS

Extended European Search Report dated Mar. 13, 2018 in corresponding application No. 15840615.7.

Hsieh et al., "Ethylene-1-Butene Copolymers. 1. Comonomer Sequence Distribution," Macromolecules 15(2): -353360 (Mar.-Apr. 1982).

Ray et al., "Carbon-13 Nuclear Magnetic Resonance Determination of Monomer Composition and Sequence Distributions in Ethylene-Propylene Copolymers Prepared with a Stereoregular Catalyst System," Macromolecules 10(4):773-778 (Jul.-Aug. 1977).

International Search Report issued in International Patent Application No. PCT/JP2015/075338 dated Oct. 6, 2015.

* cited by examiner

LUBRICANT COMPOSITIONS

CROSS-REFERENCE TO RELATED APPLICATIONS

The present application is a U.S. national stage application claiming the benefit of International Patent Application No. PCT/JP2015/075338, filed Sep. 7, 2015, which claims the benefit of priority to Japanese Patent Application No. 2014-184149, filed Sep. 10, 2014, the entireties of which are hereby incorporated by reference.

TECHNICAL FIELD

The present invention relates to lubricant compositions having excellent temperature viscosity characteristics and low-temperature viscosity characteristics and also having outstanding shear stability.

BACKGROUND ART

Lubricants such as gear oils, transmission oils, hydraulic oils and greases are required to protect and release heat from internal combustion engines and machine tools, and are also required to meet various properties such as wear resistance, heat resistance, sludge resistance, lubricant consumption characteristics and fuel efficiency. As internal combustion engines and industrial machines which are lubricated have grown in performance and output and have come to be operated under severer conditions in recent years, the lubricant performance that is required is more and more advanced. Recently, in particular, an extension in lubricant life tends to be demanded out of environmental considerations despite the fact that the conditions under which lubricants are used are becoming harsher. This tendency has given rise to a demand for enhancements in heat resistance and oxidation stability, and has further created a demand that the decrease in viscosity due to shear stress caused by engines and machines be reduced, that is, lubricants exhibit enhanced shear stability. On the other hand, in order to enhance the energy conversion efficiency of engines or to ensure good lubrication of engines in an extremely cold environment, importance is placed on temperature viscosity characteristics in which lubricants keep the form of an oil film at high temperatures while still attaining good retention of fluidity at low temperatures. One of the indicators to quantify the temperature viscosity characteristics discussed here is a viscosity index calculated by the method described in JIS K2283. The higher the viscosity index of a lubricant, the more excellent the temperature viscosity characteristics.

As described above, there has been a demand for lubricants having excellent heat resistance, oxidation stability and shear stability and also having good temperature viscosity characteristics.

In particular, lubricants used in automobiles, specifically, automotive gear oils such as differential gear oils and drive oils represented by transmission oils have come to be required to outperform the conventional lubricants in temperature viscosity characteristics and further to exhibit high fluidity at an extremely low temperature such as −40° C., namely, to have excellent low-temperature viscosity characteristics. These viscosity characteristics, which directly affect the fuel efficiency performance of automobiles, are required to be enhanced because after the adoption of the Kyoto Protocol in 1997, governments in the world have recently worked on or have set future targets on controlling carbon dioxide emissions from vehicles and regulating the fuel efficiency.

Based on the governmental decisions, automotive machine parts are more and more compact and receive less lubricants in order to enhance the fuel efficiency so that the fuel efficiency targets will be accomplished. This situation increases the load on lubricants and has given rise to a need for a further increase in lubricant life.

Since automotive gear oils or transmission oils are subjected to shear stress that is applied by gears, metallic belts or the like, molecules used in the lubricant base are broken during use. Consequently, lubricant viscosity reduces. The decrease in lubricant viscosity causes metallic parts in gears to be in contact together, resulting in significant damages to the gears. It is therefore necessary to design the viscosity of a lubricant as produced (the initial viscosity) to be high beforehand in expectation of a viscosity drop during use so that the lubricant after being degraded by use can provide ideal lubrication. SAE (the Society of Automotive Engineers) J306 (automotive gear oil viscosity classification) defines the minimum viscosities after the shear test specified by CRC L-45-T-93 (method C, 20 hours).

As a matter of fact, the life of a lubricant can be increased as the base used in the lubricant has higher shear stability. In this case, the lubricant does not need to be designed with a high initial viscosity and consequently the resistance experienced by gears during stirring of the lubricant can be reduced, which results in an enhancement in fuel efficiency.

Further, good temperature viscosity characteristics, in other words, low dependence of lubricant viscosity on temperature makes an increase in lubricant viscosity small even in a cold environment. Consequently, the increase in gear resistance due to the lubricant is relatively small as compared to conventional levels, and thus the fuel efficiency can be enhanced.

Meanwhile, the risk of contact between metallic parts in gears is increasingly high as a result of a recent approach to enhancing fuel efficiency by the reduction of the stirring resistance of lubricants by lowering the viscosity of differential gear oils or transmission oils to below the conventional level. Thus, materials that are extremely stable to shear and do not decrease viscosity are desired.

Based on this demand for performance enhancement, with respect to the J306 classification of minimum viscosities after 20 hours of the CRC L-45-T-93 shear test, it has been gradually required to meet a new classification that defines minimum viscosities to be possessed by drive oils after the same test for 5 times as long as usual, namely, 100 hours.

Poly-α-olefins (PACs) are synthetic lubricants that are widely used in industry as lubricant base oils satisfying the above requirement. As described in, among others, Patent Documents 1 to 3, PAOs may be obtained by the oligomerization of higher α-olefins using acid catalysts.

As described in Patent Document 4, ethylene/α-olefin copolymers, similarly to PACs, are known to be employable as synthetic lubricants having excellent viscosity index, oxidation stability, shear stability and heat resistance.

Conventional methods for the production of ethylene/α-olefin copolymers used as synthetic lubricants involve vanadium catalysts including a vanadium compound and an organoaluminum compound as described in Patent Document 5 and Patent Document 6. The mainstream of ethylene/α-olefin copolymers produced by such methods is ethylene-propylene copolymers.

Methods using catalyst systems including a metallocene compound such as zirconocene and an organoaluminum oxy compound (aluminoxane) such as, among others, those described in Patent Document 7 and Patent Document 8 are known to produce copolymers with high polymerization activity. Patent Document 9 discloses a method for producing a synthetic lubricant including an ethylene/α-olefin copolymer produced by using a combination of a specific metallocene catalyst and an aluminoxane as a catalyst system.

In recent years, there has been an increasing trend in the demand for PACs, ethylene-propylene copolymers or the like, which are synthetic lubricant bases having excellent low-temperature viscosity characteristics, heat resistance and oxidation stability. From the points of view of higher fuel efficiency and energy saving, further improvements in viscosity index and low-temperature viscosity characteristics are desired.

To meet such demands, PAOs have been invented which are obtained by, among others, methods described in Patent Documents 10 to 13 using a catalyst system including a metallocene compound such as zirconocene and an organoaluminum oxy compound (aluminoxane).

It is known that the shear stability of lubricant compositions is dependent on the molecular weights of constituent components. That is, a lubricant composition which contains components having a higher molecular weight is more apt to decrease its viscosity when subjected to shear stress and the rate of this viscosity drop is correlated with the molecular weights of components present in the composition.

On the other hand, the incorporation of high-molecular weight components enhances the temperature viscosity characteristics and low-temperature viscosity characteristics of lubricant compositions. That is, while components such as PAOs and ethylene-propylene copolymers provide an enhancement in the temperature viscosity characteristics of lubricant compositions as their molecular weights are higher, there is a trade-off in that shear stability is decreased. In this regard, lubricants have room for improvement in terms of the satisfaction of shear stability and temperature viscosity characteristics at the same time.

CITATION LIST

Patent Literature

Patent Document 1: U.S. Pat. No. 3,780,128
Patent Document 2: U.S. Pat. No. 4,032,591
Patent Document 3: JP-A-H01-163136
Patent Document 4: JP-A-S57-117595
Patent Document 5: JP-B-H02-1163
Patent Document 6: JP-B-H02-7998
Patent Document 7: JP-A-S61-221207
Patent Document 8: JP-B-H07-121969
Patent Document 9: Japanese Patent No. 2796376
Patent Document 10: JP-A-2001-335607
Patent Document 11: JP-A-2004-506758
Patent Document 12: JP-A-2009-503147
Patent Document 13: JP-A-2009-514991

SUMMARY OF INVENTION

Technical Problem

In light of the problems in the art discussed above and from the points of view of improving the fuel efficiency and saving energies of automobiles and industrial machines, an object of the present invention is to provide lubricants having outstanding shear stability and low-temperature viscosity characteristics.

Solution to Problem

The present inventors carried out extensive studies directed to developing lubricant compositions having excellent performance. As a result, the present inventors have found that lubricant compositions including a specific lubricant base oil and a specific α-olefin (co)polymer and satisfying specific requirements can solve the problems discussed above, thus completing the present invention.

The present inventors have subjected lubricant compositions to 100 hours of a shear test in accordance with the method described in CRC L-45-T-93 and have consequently revealed that a specific molecular weight region of the lubricant compositions are affected. Based on this finding, the present inventors have optimized lubricant compositions and have invented lubricant compositions having high shear stability, temperature viscosity characteristics and low-temperature viscosity characteristics. Specifically, some aspects of the invention reside in the following.

[1] A lubricant composition including a lubricant base oil (A) having a kinematic viscosity at 100° C. of 1 to 10 $mm^2/s$, and an ethylene/α-olefin copolymer (B) having characteristics (B1) to (B4) described below, the lubricant composition having a kinematic viscosity at 100° C. of not more than 20 $mm^2/s$, the lubricant composition having a peak top of molecular weight in the range of 3,000 to 10,000 as measured by gel permeation chromatography (GPC) with reference to polystyrene standards, the lubricant composition having a weight fraction of components having a molecular weight not less than 20,000, measured with reference to polystyrene standards, of 1 to 10% relative to all components having a molecular weight not less than the molecular weight that gives the above peak top, (B1) the peak top molecular weight measured by gel permeation chromatography (GPC) with reference to polystyrene standards is 3,000 to 10,000, (B2) the copolymer shows no melting peak as measured on a differential scanning calorimeter (DSC), (B3) the value B represented by the equation [1] below is not less than 1.1

$$B = \frac{P_{OE}}{2P_O \cdot P_E} \quad [1]$$

wherein $P_E$ is the molar fraction of ethylene components, $P_O$ is the molar fraction of α-olefin components, and $P_{OE}$ is the molar fraction of ethylene-α-olefin sequences relative to all dyad sequences, (B4) the kinematic viscosity at 100° C. is 140 to 500 $mm^2/s$.

[2] The lubricant composition described in [1], wherein the molar content of ethylene in the ethylene/α-olefin copolymer (B) is in the range of 30 to 70 mol %.

[3] The lubricant composition described in [1] or [2], wherein the α-olefin in the ethylene/α-olefin copolymer (B) is propylene.

[4] The lubricant composition described in any of [1] to [3], which is an automotive lubricant composition.

[5] An automotive transmission oil including the lubricant composition described in [4], the lubricant composition having a kinematic viscosity at 100° C. of not more than 7.5 $mm^2/s$.

Advantageous Effects of Invention

The lubricant compositions of the present invention have outstanding shear stability, good temperature viscosity characteristics and excellent low-temperature viscosity characteristics compared to conventional lubricants, and can be suitably used as automotive lubricants and automotive transmission oils, in particular, automotive gear oils and automotive low-viscosity transmission oils.

DESCRIPTION OF EMBODIMENTS

Figure 1:
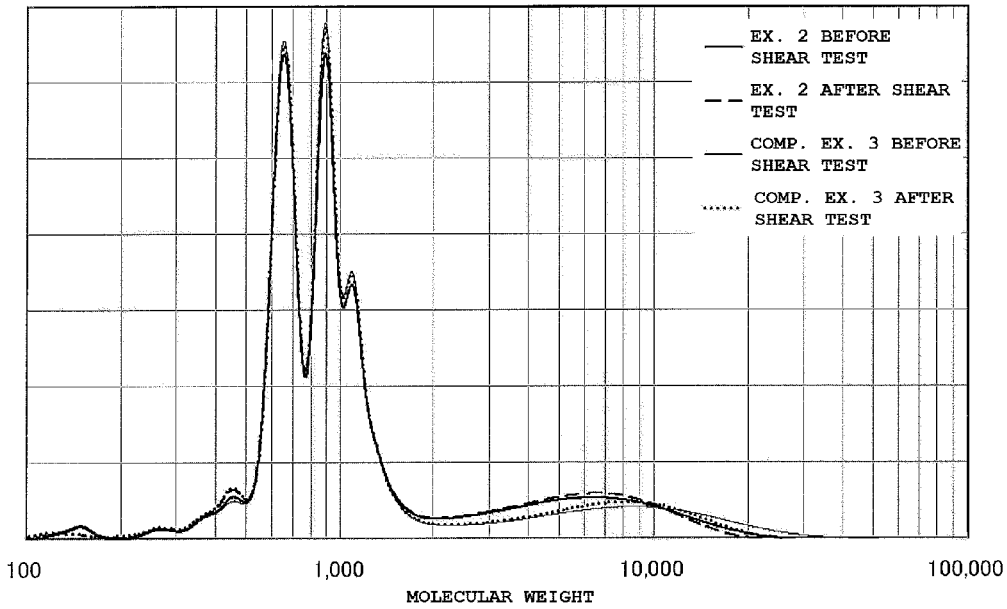
FIG. 1 compares GPC charts of lubricant compositions in Example 2 and Comparative Example 3 before (actual lines) and after (broken lines) a shear test.

Hereinbelow, lubricant compositions of the present invention will be described in detail.

⟨Lubricant Base Oils (A)⟩

The lubricant base oil (A) is not particularly limited as long as the kinematic viscosity at 100° C. is 1 to 10 $mm^2/s$. Any mineral lubricant base oils and/or synthetic lubricant base oils (hereinafter, also written as "synthetic hydrocarbon oils") used in usual lubricants may be used.

Mineral lubricant base oils are classified into grades depending on how they are purified. A specific example is lubricant base oils obtained by a process in which atmospheric residue obtained by the atmospheric distillation of crude oil is vacuum distilled and the resultant lubricant fraction is purified by one or more treatments such as solvent deasphalting, solvent extraction, hydrocracking, solvent dewaxing and hydrogenation purification. Another example of the lubricant base oils is wax isomerized mineral oils.

Further, gas-to-liquid (GTL) base oils obtained by the Fischer-Tropsch process are another suitable lubricant base oils. Such GTL base oils are described in, for example, EP0776959, EP0668342, WO 97/21788, WO 00/15736, WO 00/14188, WO00/14187, WO00/14183, WO00/14179, WO00/08115, WO99/41332, EP1029029, WO 01/18156 and WO 01/57166.

Examples of the synthetic hydrocarbon oils include α-olefin oligomers, alkylbenzenes, alkylnaphthalenes, isobutene oligomers or hydrogenated products thereof, paraffins, polyoxyalkylene glycols, dialkyl diphenyl ethers, polyphenyl ethers and fatty acid esters.

The α-olefin oligomers may be low-molecular weight oligomers of at least one olefin selected from olefins having 8 to 12 carbon atoms (except the ethylene/α-olefin copolymers (B)). The incorporation of an α-olefin oligomer into the inventive lubricant composition allows the lubricant composition to attain outstanding temperature viscosity characteristics, low-temperature viscosity characteristics and heat resistance. Such α-olefin oligomers may be produced by cationic polymerization, thermal polymerization or radical polymerization catalyzed by Ziegler catalysts or Lewis acids. Alternatively, such oligomers may be purchased in industry, and those having a kinematic viscosity at 100° C. of 2 $mm^2/s$ to 100 $mm^2/s$ are commercially available. Examples include NEXBASE manufactured by NESTE, Spectrasyn manufactured by ExxonMobil Chemical, Durasyn manufactured by INEOS Oligomers, and Synfluid manufactured by Chevron Phillips Chemical.

The alkylbenzenes and the alkylnaphthalenes are most often dialkylbenzenes or dialkylnaphthalenes usually having alkyl chains composed of 6 to 14 carbon atoms. Such alkylbenzenes and alkylnaphthalenes are produced by the Friedel-Crafts alkylation of benzene or naphthalene with olefins. The alkyl olefins used in the production of the alkylbenzenes or the alkylnaphthalenes may be linear or branched olefins or combinations of such olefins. For example, a method for producing such compounds is described in U.S. Pat. No. 3,909,432.

Examples of the fatty acid esters, although not particularly limited to, include the following fatty acid esters composed solely of carbon, oxygen and hydrogen.

Examples include monoesters produced from monobasic acids and alcohols; diesters produced from dibasic acids and alcohols, or from diols and monobasic acids or acid mixtures; and polyol esters produced by reacting monobasic acids or acid mixtures with diols, triols (for example, trimethylolpropane), tetraols (for example, pentaerythritol) hexaols (for example, dipentaerythritol) or the like. Examples of such esters include ditridecyl glutarate, di-2-ethylhexyl adipate, diisodecyl adipate, ditridecyl adipate, di-2-ethylhexyl sebacate, tridecyl pelargonate, di-2-ethylhexyl adipate, di-2-ethylhexyl azelate, trimethylolpropane caprylate, trimethylolpropane pelargonate, trimethylolpropane triheptanoate, pentaerythritol-2-ethylhexanoate, pentaerythritol pelargonate, and pentaerythritol tetraheptanoate.

From the point of view of the compatibility with the copolymer (B) described later, specifically, the alcohol moiety constituting the ester is preferably an alcohol having two or more hydroxyl groups, and the fatty acid moiety is preferably a fatty acid having 8 or more carbon atoms. In view of production costs, the fatty acid is advantageously one having 20 or less carbon atoms which can be easily obtained in industry. The performance disclosed in the invention may be fully attained regardless of whether the fatty acid constituting the ester is a single acid or an acid mixture of two or more acids. Specific examples of the esters include trimethylolpropane laurate/stearate triester and diisodecyl adipate, which are preferable in terms of the compatibility with saturated hydrocarbon components such as the copolymer (B) and with stabilizers having a polar group described later such as antioxidants, corrosion inhibitors, antiwear agents, friction modifiers, pour point depressants, antirust agents and antifoaming agents.

When a synthetic hydrocarbon oil is used as the lubricant base oil (A), it is preferable that the inventive lubricant composition contain a fatty acid ester in an amount of 5 to 20 mass % with respect to the whole lubricant composition taken as 100 mass %. The incorporation of 5 mass % or more of a fatty acid ester provides good compatibility with lubricant sealants such as resins and elastomers in various internal combustion engines and inner portion of industrial machines. Specifically, the swelling of lubricant sealants can be prevented. From the point of view of oxidation stability or heat resistance, the amount of the ester is preferably not more than 20 mass %. When the lubricant composition contains a mineral oil, the fatty acid ester is not always necessary because the mineral oil itself serves to prevent the swelling of lubricant sealants.

In the lubricant composition of the invention, the lubricant base oil (A) may be a single mineral lubricant base oil or a single synthetic lubricant base oil, or may be a mixture of any two or more lubricants selected from mineral lubricant base oils and synthetic lubricant base oils.

The kinematic viscosity of the lubricant base oil (A) at 100° C. is 1 to 10 $mm^2/s$, and preferably 2 to 7 $mm^2/s$ as measured in accordance with the method described in JIS K2283. Any higher viscosity leads to poor temperature viscosity characteristics of the lubricant composition, and any lower viscosity results in an increase in the weight loss of the lubricant composition by evaporation at high temperature.

⟨Ethylene/α-Olefin Copolymers (B)⟩

The ethylene/α-olefin copolymer (B) is a copolymer of ethylene and an α-olefin, and has the following characteristics (B1), (B2), (B3) and (B4).

(B1) Molecular Weight

The ethylene/α-olefin copolymer (B) has a peak top molecular weight, which is measured by gel permeation chromatography (GPC) in accordance with a method described later with reference to polystyrene standards, of 3,000 to 10,000, preferably 5,000 to 9,000, and still more preferably 6,000 to 8,000. Here, the peak top molecular weight is the molecular weight that gives the highest maximum value of dw/dLog(M) (M is the molecular weight, and w is the weight fraction of the component having the corresponding molecular weight) in a molecular weight distribution curve. In the case where the curve includes a plurality of such molecular weights, the molecular weight that is largest is taken as the peak top molecular weight. Any peak top molecular weight that is below the above range causes deteriorations in the viscosity temperature characteristics and low-temperature viscosity characteristics of the lubricant composition described later. If the peak top molecular weight is higher than the above range, the shear stability of the lubricant composition is deteriorated.

In the specification, the term "molecular weight distribution curve" or "GPC chart" means a differential molecular weight distribution curve.

(B2) Melting Point

The ethylene/α-olefin copolymer (B) shows no melting peak as measured on a differential scanning calorimeter (DSC). The phrase "shows no melting peak" means that any heat of fusion ΔH is not substantially observed in DSC measurement and the copolymer has no melting point. That is, it is meant that the copolymer is an amorphous polymer. The phrase "any heat of fusion (ΔH) is not substantially observed" means that no peaks are observed in DSC measurement or the heat of fusion that is observed is not more than 1 J/g. If the ethylene/α-olefin copolymer has crystallinity, the low-temperature viscosity characteristics of the lubricant composition are deteriorated. The DSC measurement conditions are described in the section of Examples.

(B3) Value B

The ethylene/α-olefin copolymer (B) has a value B represented by the equation [1] below of not less than 1.1, and preferably not less than 1.2.

$$B = \frac{P_{OE}}{2P_O \cdot P_E} \quad [1]$$

In the equation [1], $P_E$ is the molar fraction of ethylene components, $P_O$ is the molar fraction of α-olefin components, and $P_{OE}$ is the molar fraction of ethylene-α-olefin sequences relative to all dyad sequences.

A larger value B indicates that the copolymer has less block sequences and has a narrow composition distribution with ethylene and the α-olefin being distributed uniformly. The length of such block sequences affects properties of the copolymer. That is, with increasing value B, the length of the block sequences is shorter and the copolymer exhibits a lower pour point and better low-temperature characteristics.

The value B is an index that indicates the randomness of the comonomer sequence distribution in the copolymer. $P_E$, $P_O$ and $P_{OE}$ in the above equation [1] may be determined by analyzing a $^{13}C$-NMR spectrum based on the reports of J. C. Randall [Macromolecules, 15, 353 (1982)] and J. Ray [Macromolecules, 10, 773 (1977)].

The conditions for the measurement of the value B are described in examples.

(B4) Kinematic Viscosity at 100° C.

The ethylene/α-olefin copolymer (B) has a kinematic viscosity, which is measured at 100° C. by the method described in JIS K2283, of 140 to 500 $mm^2/s$, preferably 250 to 450 $mm^2/s$, and more preferably 250 to 380 $mm^2/s$. This kinematic viscosity at 100° C. of the ethylene/α-olefin copolymer (B) is preferable in terms of the low-temperature viscosity characteristics of the lubricant composition.

The ethylene/α-olefin copolymer (B) has an ethylene content in the range of usually 30 to 70 mol %, preferably 40 to 70 mol %, and particularly preferably 45 to 65 mol %. Any lower ethylene content leads to poor viscosity temperature characteristics. If the ethylene content is higher than the above range, the extension of ethylene chains in the molecules may give rise to crystallinity, resulting in deteriorations in low-temperature viscosity characteristics.

The ethylene content is measured by $^{13}C$-NMR in accordance with the method described in "Koubunshi Bunseki Handbook (Polymer Analysis Handbook)" (published from Asakura Publishing Co., Ltd., pp. 163-170). Alternatively, the ethylene content may be determined by Fourier transform infrared spectroscopy (FT-IR) using samples with a known ethylene content prepared by the above method.

In the ethylene/α-olefin copolymer (B), the total number of double bonds in the molecular chains derived from vinyl, vinylidene, disubstituted olefins and trisubstituted olefins is less than 0.5, preferably less than 0.3, more preferably less than 0.2, and still more preferably less than 0.1 per 1000 carbon atoms according to $^1H$-NMR. This amount of double bonds in the molecular chains ensures that the lubricant composition will attain good heat resistance.

Examples of the α-olefins used in the ethylene/α-olefin copolymer (B) include linear or branched α-olefins having 3 to 20 carbon atoms such as propylene, 1-butene, 1-pentene, 3-methyl-1-butene, 1-hexene, 4-methyl-1-pentene, 3-methyl-1-pentene, 1-octene, 1-decene, 1-dodecene, 1-tetradecene, 1-hexadecene, 1-octadecene, 1-eicosene and vinylcyclohexane. Preferred α-olefins are linear or branched α-olefins having 3 to 10 carbon atoms. Propylene, 1-butene, 1-hexene and 1-octene are more preferable. Propylene is most preferable in terms of the shear stability of lubricating oils including the obtainable copolymer. The α-olefins may be used singly, or two or more may be used in combination.

The polymerization may be performed in the presence of at least one selected from polar group-containing monomers, aromatic vinyl compounds and cycloolefins in the reaction system. Such monomers may be used in an amount of, for example, not more than 20 parts by mass, and preferably not more than 10 parts by mass with respect to 100 parts by mass of the total of ethylene and the α-olefin(s) having 3 to 20 carbon atoms.

Examples of the polar group-containing monomers include α,β-unsaturated carboxylic acids such as acrylic acid, methacrylic acid, fumaric acid and maleic anhydride; metal salts of these acids such as sodium salts; α,β-unsaturated carboxylate esters such as methyl acrylate, ethyl acrylate, n-propyl acrylate, methyl methacrylate and ethyl methacrylate; vinyl esters such as vinyl acetate and vinyl propionate; and unsaturated glycidyls such as glycidyl acrylate and glycidyl methacrylate.

Examples of the aromatic vinyl compounds include styrene, o-methylstyrene, m-methylstyrene, p-methylstyrene, o,p-dimethylstyrene, methoxystyrene, vinylbenzoic acid, methyl vinylbenzoate, vinylbenzyl acetate, hydroxystyrene, p-chlorostyrene, divinylbenzene, α-methylstyrene and allylbenzene.

Examples of the cycloolefins include those cycloolefins having 3 to 30, preferably 3 to 20 carbon atoms such as cyclopentene, cycloheptene, norbornene, 5-methyl-2-norbornene and tetracyclododecene.

The ethylene/α-olefin copolymer (B) may be produced by any methods without limitation. As described in Patent Document 5 and Patent Document 6, the production may be catalyzed by a vanadium catalyst including a vanadium compound and an organoaluminum compound. To produce the copolymer with high polymerization activity, as described in Patent Documents 7 to 9, use may be made of methods using a catalyst system including a metallocene compound such as zirconocene and an organoaluminum oxy compound (aluminoxane); these methods are preferable in that the obtainable copolymer has a reduced chlorine content and a reduced amount of 2,1-insertion of propylene. The vanadium-catalyzed method involves a larger amount of a chlorine compound as a cocatalyst than the metallocene-catalyzed method, and thus may leave a trace amount of chlorine in the obtainable ethylene/α-olefin copolymer (B).

In contrast, the metallocene-catalyzed method does not substantially leave chlorine and makes it unnecessary to take measures against the risk of corrosion of metallic parts in internal combustion engines, machines and the like. Further, the reduction in the amount of 2,1-insertion of propylene reduces the amount of ethylene sequences in the molecules of the copolymer, resulting in enhancements in viscosity temperature characteristics and low-temperature viscosity characteristics.

In particular, the following method can produce an ethylene/α-olefin copolymer (B) having a good performance balance in terms of molecular weight control, molecular weight distribution, amorphousness and the value B.

The ethylene/α-olefin copolymer (B) may be produced by copolymerizing ethylene with an α-olefin having 3 to 20 carbon atoms in the presence of an olefin polymerization catalyst including a bridged metallocene compound (a) represented by the general formula [I] below, and at least one compound (b) selected from the group consisting of organometallic compounds (b-1), organoaluminum oxy compounds (b-2) and compounds (b-3) capable of reacting with the bridged metallocene compound (a) to form an ion pair.

[I]

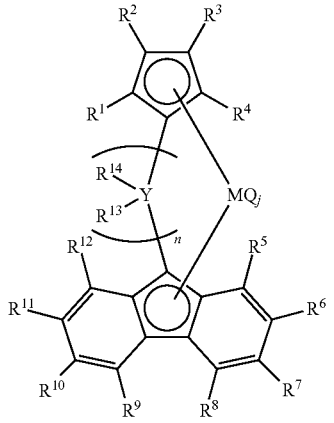

⟨Bridged Metallocene Compounds⟩

The bridged metallocene compound (a) is represented by the formula [I] above. The bridged metallocene compound represented by the formula [I] gives copolymers having short blockwise sequences, namely, a large value B. Y, M, $R^1$ to $R^{14}$, Q, n and j in the formula [I] will be described below.

(Y, M, $R^1$ to $R^{12}$, Q, n and j)

Y is a Group 14 element, with examples including carbon atom, silicon atom, germanium atom and tin atom, and is preferably a carbon atom or a silicon atom, and more preferably a carbon atom.

M is a titanium atom, a zirconium atom or a hafnium atom, and preferably a zirconium atom.

$R^1$ to $R^{12}$ are each an atom or a substituent selected from the group consisting of a hydrogen atom, a hydrocarbon group having 1 to 20 carbon atoms, a silicon-containing group, a nitrogen-containing group, an oxygen-containing group, a halogen atom and a halogen-containing group, and may be the same as or different from one another. Any adjacent substituents among $R^1$ to $R^{12}$ may be bonded together to form a ring or may not be bonded together.

Examples of the hydrocarbon groups having 1 to 20 carbon atoms include alkyl groups having 1 to 20 carbon atoms, cyclic saturated hydrocarbon groups having 3 to 20 carbon atoms, chain unsaturated hydrocarbon groups having 2 to 20 carbon atoms, cyclic unsaturated hydrocarbon groups having 3 to 20 carbon atoms, alkylene groups having 1 to 20 carbon atoms, and arylene groups having 6 to 20 carbon atoms.

Examples of the alkyl groups having 1 to 20 carbon atoms include linear saturated hydrocarbon groups such as methyl group, ethyl group, n-propyl group, allyl group, n-butyl group, n-pentyl group, n-hexyl group, n-heptyl group, n-octyl group, n-nonyl group and n-decanyl group, and branched saturated hydrocarbon groups such as isopropyl group, isobutyl group, s-butyl group, t-butyl group, t-amyl group, neopentyl group, 3-methylpentyl group, 1,1-diethylpropyl group, 1,1-dimethylbutyl group, 1-methyl-1-propylbutyl group, 1,1-propylbutyl group, 1,1-dimethyl-2-methylpropyl group, 1-methyl-1-isopropyl-2-methylpropyl group and cyclopropylmethyl group. The number of carbon atoms in the alkyl groups is preferably 1 to 6.

Examples of the cyclic saturated hydrocarbon groups having 3 to 20 carbon atoms include cyclic saturated hydrocarbon groups such as cyclopropyl group, cyclobutyl group, cyclopentyl group, cyclohexyl group, cycloheptyl group, cyclooctyl group, norbornenyl group, 1-adamantyl group and 2-adamantyl group; and groups resulting from the substitution of the cyclic saturated hydrocarbon groups with a $C_{1-17}$ hydrocarbon group in place of a hydrogen atom such as 3-methylcyclopentyl group, 3-methylcyclohexyl group, 4-methylcyclohexyl group, 4-cyclohexylcyclohexyl group and 4-phenylcyclohexyl group. The number of carbon atoms in the cyclic saturated hydrocarbon groups is preferably 5 to 11.

Examples of the chain unsaturated hydrocarbon groups having 2 to 20 carbon atoms include alkenyl groups such as ethenyl group (vinyl group), 1-propenyl group, 2-propenyl group (allyl group) and 1-methylethenyl group (isopropenyl group), and alkynyl groups such as ethynyl group, 1-propynyl group and 2-propynyl group (propargyl group). The number of carbon atoms in the chain unsaturated hydrocarbon groups is preferably 2 to 4.

Examples of the cyclic unsaturated hydrocarbon groups having 3 to 20 carbon atoms include cyclic unsaturated hydrocarbon groups such as cyclopentadienyl group, norbornyl group, phenyl group, naphthyl group, indenyl group, azulenyl group, phenanthryl group and anthracenyl group; groups resulting from the substitution of the cyclic unsaturated hydrocarbon groups with a $C_{1-15}$ hydrocarbon group in place of a hydrogen atom such as 3-methylphenyl group (m-tolyl group), 4-methylphenyl group (p-tolyl group), 4-ethylphenyl group, 4-t-butylphenyl group, 4-cyclohexylphenyl group, biphenylyl group, 3,4-dimethylphenyl group, 3,5-dimethylphenyl group and 2,4,6-trimethylphenyl group (mesityl group); and groups resulting from the substitution of the linear hydrocarbon groups or branched saturated hydrocarbon groups with a $C_{3-19}$ cyclic saturated hydrocarbon or cyclic unsaturated hydrocarbon group in place of a hydrogen atoms such as benzyl group and cumyl group. The number of carbon atoms in the cyclic unsaturated hydrocarbon groups is preferably 6 to 10.

Examples of the alkylene groups having 1 to 20 carbon atoms include methylene group, ethylene group, dimethylmethylene group (isopropylidene group), ethylmethylene group, methylethylene group and n-propylene group. The number of carbon atoms in the alkylene groups is preferably 1 to 6.

Examples of the arylene groups having 6 to 20 carbon atoms include o-phenylene group, m-phenylene group, p-phenylene group and 4,4'-biphenylylene group. The number of carbon atoms in the arylene groups is preferably 6 to 12.

Examples of the silicon-containing groups include groups resulting from the substitution of the $C_{1-20}$ hydrocarbon groups with a silicon atom in place of a carbon atom, specifically, alkylsilyl groups such as trimethylsilyl group, triethylsilyl group, t-butyldimethylsilyl group and triisopropylsilyl group, arylsilyl groups such as dimethylphenylsilyl group, methyldiphenylsilyl group and t-butyldiphenylsilyl group, and pentamethyldisilanyl group and trimethylsilylmethyl group. The number of carbon atoms in the alkylsilyl groups is preferably 1 to 10, and the number of carbon atoms in the arylsilyl groups is preferably 6 to 18.

Examples of the nitrogen-containing groups include amino group; groups resulting from the substitution of the aforementioned $C_{1-20}$ hydrocarbon groups or silicon-containing groups with a nitrogen atom in place of a =CH— structural unit, with a nitrogen atom, to which a $C_{1-20}$ hydrocarbon group is bound, in place of a —$CH_2$— structural unit, or with a nitrile group or a nitrogen atom, to which $C_{1-20}$ hydrocarbon groups are bound, in place of a —$CH_3$ structural unit such as dimethylamino group, diethylamino group, N-morpholinyl group, dimethylaminomethyl group, cyano group, pyrrolidinyl group, piperidinyl group and pyridinyl group; and N-morpholinyl group and nitro group. Preferred nitrogen-containing groups are dimethylamino group and N-morpholinyl group.

Examples of the oxygen-containing groups include hydroxyl group, and groups resulting from the substitution of the aforementioned $C_{1-20}$ hydrocarbon groups, silicon-containing groups or nitrogen-containing groups with an oxygen atom or a carbonyl group in place of a —$CH_2$— structural unit, or with an oxygen atom bonded to a $C_{1-20}$ hydrocarbon group in place of a —$CH_3$ structural unit such as methoxy group, ethoxy group, t-butoxy group, phenoxy group, trimethylsiloxy group, methoxyethoxy group, hydroxymethyl group, methoxymethyl group, ethoxymethyl group, t-butoxymethyl group, 1-hydroxyethyl group, 1-methoxyethyl group, 1-ethoxyethyl group, 2-hydroxyethyl group, 2-methoxyethyl group, 2-ethoxyethyl group, n-2-oxabutylene group, n-2-oxapentylene group, n-3-oxapentylene group, aldehyde group, acetyl group, propionyl group, benzoyl group, trimethylsilylcarbonyl group, carbamoyl group, methylaminocarbonyl group, carboxy group, methoxycarbonyl group, carboxymethylgroup, ethocarboxymethyl group, carbamoylmethyl group, furanyl group and pyranyl group. A preferred oxygen-containing group is methoxy group.

Examples of the halogen atoms include Group XVII elements such as fluorine, chlorine, bromine and iodine.

Examples of the halogen-containing groups include groups resulting from the substitution of the aforementioned $C_{1-20}$ hydrocarbon groups, silicon-containing groups, nitrogen-containing groups or oxygen-containing groups with a halogen atom in place of a hydrogen atom such as trifluoromethyl group, tribromomethyl group, pentafluoroethyl group and pentafluorophenyl group.

Q is a halogen atom, a hydrocarbon group having 1 to 20 carbon atoms, an anionic ligand or a neutral ligand capable of coordination through a lone pair of electrons, and may be the same or different.

The details of the halogen atoms and the hydrocarbon groups having 1 to 20 carbon atoms are as described above. When Q is a halogen atom, a chlorine atom is preferable. When Q is a hydrocarbon group having 1 to 20 carbon atoms, the number of carbon atoms in the hydrocarbon group is preferably 1 to 7.

Examples of the anionic ligands include alkoxy groups such as methoxy group, t-butoxy group and phenoxy group, carboxylate groups such as acetate and benzoate, and sulfonate groups such as mesylate and tosylate.

Examples of the neutral ligands capable of coordination through a lone pair of electrons include organophosphorus compounds such as trimethylphosphine, triethylphosphine, triphenylphosphine and diphenylmethylphosphine, and ether compounds such as tetrahydrofuran, diethyl ether, dioxane and 1,2-dimethoxyethane.

The letter j is an integer of 1 to 4, and preferably 2.

The letter n is an integer of 1 to 4, preferably 1 or 2, and more preferably 1.

$R^{13}$ and $R^{14}$ are each an atom or a substituent selected from the group consisting of a hydrogen atom, a hydrocarbon group having 1 to 20 carbon atoms, an aryl group, a substituted aryl group, a silicon-containing group, a nitrogen-containing group, an oxygen-containing group, a halogen atom and a halogen-containing group, and may be the same as or different from each other. $R^{13}$ and $R^{14}$ may be bonded together to form a ring or may not be bonded to each other.

The details of the hydrocarbon groups having 1 to 20 carbon atoms, the silicon-containing groups, the nitrogen-containing groups, the oxygen-containing groups, the halogen atoms and the halogen-containing groups are as described hereinabove.

Examples of the aryl groups include substituents derived from aromatic compounds such as phenyl group, 1-naphthyl group, 2-naphthyl group, anthracenyl group, phenanthrenyl group, tetracenyl group, chrysenyl group, pyrenyl group, indenyl group, azulenyl group, pyrrolyl group, pyridyl group, furanyl group and thiophenyl group. Some of these aryl groups overlap with some of the aforementioned cyclic unsaturated hydrocarbon groups having 3 to 20 carbon atoms. Preferred aryl groups are phenyl group and 2-naphthyl group.

Examples of the aromatic compounds include aromatic hydrocarbons and heterocyclic aromatic compounds such as benzene, naphthalene, anthracene, phenanthrene, tetracene, chrysene, pyrene, indene, azulene, pyrrole, pyridine, furan and thiophene.

Examples of the substituted aryl groups include groups resulting from the substitution of the above aryl groups with at least one substituent selected from the group consisting of hydrocarbon groups having 1 to 20 carbon atoms, aryl groups, silicon-containing groups, nitrogen-containing groups, oxygen-containing groups, halogen atoms and halogen-containing groups in place of one or more hydrogen atoms in the aryl groups. Specific examples include 3-methylphenyl group (m-tolyl group), 4-methylphenyl group (p-tolyl group), 3-ethylphenyl group, 4-ethylphenyl group, 3,4-dimethylphenyl group, 3,5-dimethylphenyl group, biphenylyl group, 4-(trimethylsilyl)phenyl group, 4-aminophenyl group, 4-(dimethylamino)phenyl group, 4-(diethylamino)phenyl group, 4-morpholinylphenyl group, 4-methoxyphenyl group, 4-ethoxyphenyl group, 4-phenoxyphenyl group, 3,4-dimethoxyphenyl group, 3,5-dimethoxyphenyl group, 3-methyl-4-methoxyphenyl group, 3,5-dimethyl-4-methoxyphenyl group, 3-(trifluoromethyl)phenyl group, 4-(trifluoromethyl)phenyl group, 3-chlorophenyl group, 4-chlorophenyl group, 3-fluorophenyl group, 4-fluorophenyl group, 5-methylnaphthyl group and 2-(6-methyl) pyridyl group. Some of these substituted aryl groups overlap with some of the aforementioned cyclic unsaturated hydrocarbon groups having 3 to 20 carbon atoms.

In the bridged metallocene compound (a) represented by the above formula [I], n is preferably 1. Such bridged metallocene compounds (hereinafter, also written as the "bridged metallocene compounds (a-1)") are represented by the following general formula [II].

[II]

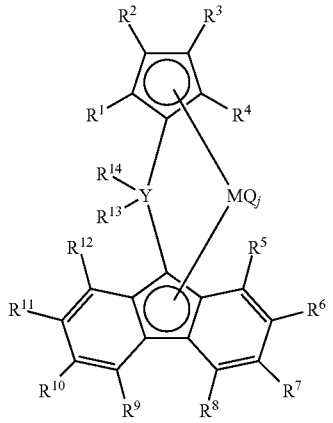

In the formula [II], Y, M, $R^1$, $R^2$, $R^3$, $R^4$, $R^5$, $R^6$, $R^7$, $R^8$, $R^9$, $R^{10}$, $R^{11}$, $R^{12}$, $R^{13}$, $R^{14}$, Q and j are as defined and described hereinabove.

The bridged metallocene compound (a-1) may be produced through simplified steps at low production cost as compared to the compounds of the formula [I] in which n is an integer of 2 to 4. Thus, the use of such a bridged metallocene compound (a-1) is advantageous in that the costs associated with the production of the ethylene/α-olefin copolymer (B) are reduced.

In the bridged metallocene compound (a-1) represented by the formula [II] above, it is preferable that $R^1$, $R^2$, $R^3$ and $R^4$ be all hydrogen atoms. Such bridged metallocene compounds (hereinafter, also written as the "bridged metallocene compounds (a-2)") are represented by the following general formula [III].

[III]

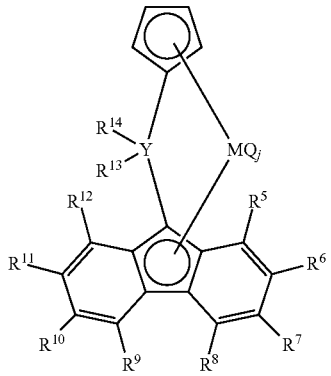

In the formula [III], Y, M, $R^5$, $R^6$, $R^7$, $R^8$, $R^9$, $R^{10}$, $R^{11}$, $R^{12}$, $R^{13}$, $R^{14}$, Q and j are as defined and described hereinabove.

The bridged metallocene compound (a-2) may be produced through simplified steps at low production cost as compared to the compounds of the formula [I] in which one or more of $R^1$, $R^2$, $R^3$ and $R^4$ are substituents other than hydrogen atoms. Thus, the use of such a bridged metallocene compound (a-2) is advantageous in that the costs for the production of ethylene/α-olefin copolymers (B) are reduced. In contrast to a general knowledge that the randomness of ethylene/α-olefin copolymers (B) is decreased at high polymerization temperatures, copolymerization of ethylene with one or more monomers selected from $C_{3-20}$ α-olefins in the presence of the olefin polymerization catalyst including the bridged metallocene compound (a-2) advantageously affords an ethylene/α-olefin copolymer (B) with high randomness even at a high polymerization temperature.

In the bridged metallocene compound (a-2) represented by the formula [III] above, it is preferable that one of $R^{13}$ and $R^{14}$ be an aryl group or a substituted aryl group. Such a bridged metallocene compound (a-3) provides an advantage that the number of double bonds in the obtainable ethylene/α-olefin copolymer (B) is small as compared to when $R^{13}$ and $R^{14}$ are both substituents other than aryl groups and substituted aryl groups.

The bridged metallocene compound (a-3) is more preferably such that one of $R^{13}$ and $R^{14}$ is an aryl group or a substituted aryl group and the other is an alkyl group having 1 to 20 carbon atoms, and is particularly preferably such that one of $R^{13}$ and $R^{14}$ is an aryl group or a substituted aryl group and the other is a methyl group. Such a bridged metallocene compound (hereinafter, also written as the "bridged metallocene compound (a-4)") provides advantages that the balance between the polymerization activity and the number of double bonds in the obtainable ethylene/α-olefin copolymer (B) is excellent and the use of the bridged metallocene compound allows for the reduction of costs associated with the production of ethylene/α-olefin copolymers (B) as compared to when $R^{13}$ and $R^{14}$ are both aryl groups or substituted aryl groups.

When polymerization is performed at a given total pressure in a polymerizer and at a given temperature, increasing the hydrogen partial pressure by the introduction of hydrogen is accompanied by a decrease in the partial pressures of olefin monomers to be polymerized and consequently the polymerization rate is disadvantageously depressed particularly when the hydrogen partial pressure is high. Because the total pressure acceptable inside a polymerization reactor is limited for design reasons, any excessive introduction of hydrogen during the production of olefin polymers, in particular, as required for the production of olefin polymers having a low molecular weight, significantly decreases the olefin partial pressure and possibly results in a decrease in polymerization activity. In contrast, the use of the bridged metallocene compound (a-4) allows the ethylene/α-olefin copolymer (B) to be produced with a reduced amount of hydrogen introduced into the polymerization reactor and thus with an enhanced polymerization activity as compared to when the bridged metallocene compound (a-3) is used, thereby providing an advantage that the costs associated with the production of ethylene/α-olefin copolymers (B) are reduced.

In the bridged metallocene compound (a-4), $R^6$ and $R^{11}$ are preferably each an alkyl group having 1 to 20 carbon atoms or an alkylene group having 1 to 20 carbon atoms and may be bonded to any of the adjacent substituents to form a ring. Such a bridged metallocene compound (hereinafter, also written as the "bridged metallocene compound (a-5)") may be produced through simplified steps at low production cost as compared to the compounds in which $R^6$ and $R^{11}$ are substituents other than alkyl groups having 1 to 20 carbon atoms and alkylene groups having 1 to 20 carbon atoms. Thus, the use of such a bridged metallocene compound (a-5) is advantageous in that the costs associated with the production of ethylene/α-olefin copolymers (B) are reduced.

In the bridged metallocene compound (a) represented by the general formula [I], the bridged metallocene compound (a-1) represented by the general formula [II], the bridged metallocene compound (a-2) represented by the general formula [III], and the bridged metallocene compounds (a-3), (a-4) and (a-5), it is more preferable that M be a zirconium atom. When M is a zirconium atom, copolymerization of ethylene with one or more monomers selected from $C_{3-20}$ α-olefins in the presence of the olefin polymerization catalyst including such a bridged metallocene compound attains high polymerization activity as compared to when M is a titanium atom or a hafnium atom, thus providing an advantage that the costs associated with the production of ethylene/α-olefin copolymers (B) are reduced.

Examples of the bridged metallocene compounds (a) include:

[dimethylmethylene($\eta^5$-cyclopentadienyl)($\eta^5$-fluorenyl)]zirconium dichloride, [dimethylmethylene($\eta^5$-cyclopentadienyl)($\eta^5$-2,7-di-t-butylfluorenyl)]zirconium dichloride, [dimethylmethylene($\eta^5$-cyclopentadienyl)($\eta^5$-3,6-di-t-butylfluorenyl)]zirconium dichloride, [dimethylmethylene($\eta^5$-cyclopentadienyl)($\eta^5$-octamethyloctahydrodi benzofluorenyl)]zirconium dichloride, [dimethylmethylene($\eta^5$-cyclopentadienyl)($\eta^5$-tetramethyloctahydrodibenzofluorenyl)]zirconium dichloride,

[cyclohexylidene($\eta^5$-cyclopentadienyl)($\eta^5$-fluorenyl)]zirconium dichloride, [cyclohexylidene($\eta^5$-cyclopentadienyl)($\eta^5$-2,7-di-t-butylfluorenyl)]zirconium dichloride, [cyclohexylidene($\eta^5$-cyclopentadienyl)($\eta^5$-3,6-di-t-butylfluorenyl)]zirconium dichloride, [cyclohexylidene($\eta^5$-cyclopentadienyl)($\eta^5$-octamethyloctahydrodibenzofluorenyl)]zirconium dichloride, [cyclohexylidene($\eta^5$-cyclopentadienyl)($\eta^5$-tetramethyloctahydrodibenzofluorenyl)]zirconium dichloride,

[diphenylmethylene($\eta^5$-cyclopentadienyl)($\eta^5$-fluorenyl)]zirconium dichloride, [diphenylmethylene($\eta^5$-cyclopentadienyl)($\eta^5$-2,7-di-t-butylfluorenyl)]zirconium dichloride, [diphenylmethylene($\eta^5$-2-methyl-4-t-butylcyclopentadienyl)($\eta^5$-2,7-di-t-butylfluorenyl)]zirconium dichloride, [diphenylmethylene($\eta^5$-cyclopentadienyl)($\eta^5$-3,6-di-t-butylfluorenyl)]zirconium dichloride, [diphenylmethylene($\eta^5$-cyclopentadienyl)($\eta^5$-octamethyloctahydrodibenzofluorenyl)]zirconium dichloride, [diphenylmethylene($\eta^5$-cyclopentadienyl)($\eta^5$-tetramethyloctahydrodibenzofluorenyl)]zirconium dichloride,

[methylphenylmethylene($\eta^5$-cyclopentadienyl)($\eta^5$-fluorenyl)]zirconium dichloride, [methylphenylmethylene($\eta^5$-cyclopentadienyl)($\eta^5$-2,7-di-t-butylfluorenyl)]zirconium dichloride, [methylphenylmethylene($\eta^5$-cyclopentadienyl)($\eta^5$-3,6-di-t-butylfluorenyl)]zirconium dichloride, [methylphenylmethylene($\eta^5$-cyclopentadienyl)($\eta^5$-octamethyloctahydrodibenzofluorenyl)]zirconium dichloride, [methylphenylmethylene($\eta^5$-cyclopentadienyl)($\eta^5$-tetramethyloctahydrodibenzofluorenyl)]zirconium dichloride,

[methyl(3-methylphenyl)methylene($\eta^5$-cyclopentadienyl) ($\eta^5$-fluorenyl)]zirconium dichloride, [methyl(3-methylphenyl)methylene($\eta^5$-cyclopentadienyl)($\eta^5$-2, 7-di-t-butylfluorenyl)]zirconium dichloride, [methyl(3-methylphenyl)methylene($\eta^5$-cyclopentadienyl)($\eta^5$-3, 6-di-t-butylfluorenyl)]zirconium dichloride, [methyl(3-methylphenyl)methylene($\eta^5$-cyclopentadienyl)($\eta^5$-octamethyloctahydrodibenzofluorenyl)]zirconium dichloride, [methyl(3-methylphenyl)methylene($\eta^5$-cyclopentadienyl)($\eta^5$-tetramethyloctahydrodibenzofluorenyl)]zirconium dichloride,

[diphenylsilylene($\eta^5$-cyclopentadienyl)($\eta^5$-fluorenyl)]zirconium dichloride, [diphenylsilylene($\eta^5$-cyclopentadienyl)($\eta^5$-2,7-di-t-butylfluorenyl)]zirconium dichloride, [diphenylsilylene($\eta^5$-cyclopentadienyl)($\eta^5$-3,6-di-t-butylfluorenyl)]zirconium dichloride, [diphenylsilylene($\eta^5$-cyclopentadienyl)($\eta^5$-octamethyloctahydrodibenzofluoren- yl)]zirconium dichloride, [diphenylsilylene($\eta^5$-cyclopentadienyl)($\eta^5$-tetramethyloctahydrodibenzofluorenyl)]zirconium dichloride,

[bis(3-methylphenyl)silylene($\eta^5$-cyclopentadienyl)($\eta^5$-fluorenyl)]zirconium dichloride, [bis(3-methylphenyl)silylene($\eta^5$-cyclopentadienyl)($\eta^5$-2,7-di-t-butylfluorenyl)]zirconium dichloride, [bis(3-methylphenyl)silylene($\eta^5$-cyclopentadienyl)($\eta^5$-3,6-di-t-butylfluorenyl)]zirconium dichloride, [bis(3-methylphenyl)silylene($\eta^5$-cyclopentadienyl)($\eta^5$-octamethyloctahydrodibenzofluorenyl)]zirconium dichloride, [bis(3-methylphenyl)silylene($\eta^5$-cyclopentadienyl)($\eta^5$-tetramethyloctahydrodibenzofluorenyl)]zirconium dichloride,

[dicyclohexylsilylene($\eta^5$-cyclopentadienyl)($\eta^5$-fluorenyl)]zirconium dichloride, [dicyclohexylsilylene($\eta^5$-cyclopentadienyl)($\eta^5$-2,7-di-t-butylfluorenyl)]zirconium dichloride, [dicyclohexylsilylene($\eta^5$-cyclopentadienyl)($\eta^5$-3,6-di-t-butylfluorenyl)]zirconium dichloride, [dicyclohexylsilylene($\eta^5$-cyclopentadienyl)($\eta^5$-octamethyloctahydrodibenzofluorenyl)]zirconium dichloride, [dicyclohexylsilylene($\eta^5$-cyclopentadienyl)($\eta^5$-tetramethyloctahydrodibenzofluorenyl)]zirconium dichloride,

[ethylene($\eta^5$-cyclopentadienyl)($\eta^5$-fluorenyl)]zirconium dichloride, [ethylene($\eta^5$-cyclopentadienyl)($\eta^5$-2,7-di-t-butylfluorenyl)]zirconium dichloride, [ethylene($\eta^5$-cyclopentadienyl)($\eta^5$-3,6-di-t-butylfluorenyl)]zirconium dichloride, [ethylene($\eta^5$-cyclopentadienyl)($\eta^5$-octamethyloctahydrodibenzofluorenyl)]zirconium dichloride and [ethylene ($\eta^5$cyclopentadienyl)($\eta^5$-tetramethyloctahydrodibenzofluorenyl)]zirconium dichloride.

Examples further include compounds corresponding to the above compounds except that the zirconium atom is replaced by a hafnium atom or except that the chloro ligand is replaced by a methyl group. The bridged metallocene compounds (a) are not limited to the examples described above. In the bridged metallocene compounds (a) described above, $\eta^5$-tetramethyloctahydrodibenzofluorenyl indicates 4,4,7,7-tetramethyl-(5a,5b,11a,12,12a-$\eta^5$)-1,2,3,4,7,8,9,10-octahydrodibenzo[b,H]fluorenyl group, and $\eta^5$-octamethyloctahydrodibenzofluorenyl indicates 1,1,4,4,7,7,10,10-octamethyl-(5a,5b,11a,12,12a-$\eta^5$)-1,2,3,4,7,8,9,10-octahydrodibenzo[b,H]fluorenyl group.

⟨Compounds (b)⟩

The polymerization catalyst used in the invention includes the bridged metallocene compound (a) described above, and at least one compound (b) selected from the group consisting of organometallic compounds (b-1), organoaluminum oxy compounds (b-2) and compounds (b-3) capable of reacting with the bridged metallocene compound (a) to form an ion pair.

Specifically, organometallic compounds of Group 1, 2, 12 and 13 metals in the periodic table described below may be used as the organometallic compounds (b-1).

(b-1a) Organoaluminum compounds represented by the general formula: $R^a{}_mAl(OR^b)_nH_pX_q$, wherein $R^a$ and $R^b$, which may be the same as or different from each other, are each a hydrocarbon group having 1 to 15, or preferably 1 to 4 carbon atoms, X is a halogen atom, $0<m\leq3$, $0\leq n<3$, $0\leq p<3$, $0\leq q<3$, and $m+n+p+q=3$ Examples of such a compound include:

tri-n-alkylaluminums such as trimethylaluminum, triethylaluminum, tri-n-butylaluminum, tri-n-hexylaluminum and tri-n-octylaluminum;

tri-branched-alkylaluminums such as triisopropylaluminum, triisobutylaluminum, trisec-butylaluminum, tri-t-butylaluminum, tri-2-methylbutylaluminum, tri-3-methylhexylaluminum and tri-2-ethylhexylaluminum;

tricycloalkylaluminums such as tricyclohexylaluminum and tricyclooctylaluminum;

triarylaluminums such as triphenylaluminum and tri(4-methylphenyl)aluminum;

dialkylaluminumhydrides such as diisopropylaluminumhydride and diisobutylaluminumhydride;

alkenylaluminum such as isoprenylaluminum represented by the general formula $(i\text{-}C_4H_9)_x(Al_y(C_5H_{10})_z$, wherein x, y and z are positive numbers, and $z\leq2x$;

alkylaluminumalkoxides such as isobutylaluminummethoxide and isobutylaluminumethoxide;

dialkylaluminumalkoxides such as dimethylaluminummethoxide, diethylaluminumethoxide and dibutylaluminumbutoxide;

alkylaluminumsesquialkoxides such as ethylaluminumsesquiethoxide and butylaluminumsesquibutoxide;

partially alkoxylated alkylaluminums having an average composition represented by the general formula $R^a{}_{2.5}Al(OR^b)_{0.5}$ and the like;

alkylaluminumaryloxides such as diethylaluminumphenoxide and diethylaluminum(2,6-di-t-butyl-4-methylphenoxide);

dialkylaluminumhalides such as dimethylaluminumchloride, diethylaluminumchloride, dibutylaluminumchloride, diethylaluminumbromide and diisobutylaluminumchloride;

alkylaluminumsesquihalides such as ethylaluminumsesquichloride, butylaluminumsesquichloride and ethylaluminumsesquibromide;

partially halogenated alkylaluminums including alkylaluminumdihalide such as ethylaluminumdichloride;

dialkylaluminumhydrides such as diethylaluminumhydride and dibutylaluminumhydride;

alkylaluminumdihydrides such as ethylaluminumdihydride and propylaluminumdihydride, and other partially hydrogenate alkylaluminum, and partially alcoxylated and halogenated alkylaluminums such as ethylaluminumethoxychloride, butylaluminumbutoxychloride and ethylaluminumethoxybromide.

Compounds similar to the compounds represented by the general formula $R^a{}_mAl(OR^b)_nH_pX_q$ can also be used, examples of which compounds including an organoaluminum compound wherein two or more aluminum compounds are bound via a nitrogen atom. Examples of such a compound specifically include $(C_2H_5)_2AlN(C_2H_5)Al(C_2H_5)_2$, and the like.

(b-1b) A complex alkylated compound of a metal of Group 1 of the periodic table and aluminum, represented by the general formula: $M^2AlR^a{}_4$, wherein $M^2$ is Li, Na or K; and $R^a$ is a hydrocarbon group having 1 to 15 carbon atoms, preferably a hydrocarbon group having 1 to 4 carbon atoms Examples of such a compound include $LiAl(C_2H_5)_4$, $LiAl(C_7H_{15})_4$, and the like.

(b-1c) A dialkyl compound of a metal of Group 2 or 12 of the periodic table, represented by the general formula: $R^aR^bM^3$, wherein $R^a$ and $R^b$, each of which may be the same or different, are a hydrocarbon group having 1 to 15 carbon atoms, preferably a hydrocarbon group having 1 to 4 carbon atoms; and $M^3$ is Mg, Zn or Cd As the organoaluminum oxy compound (b-2), a conventionally known aluminoxane can be used as it is. Specifically, examples of such a compound include compounds represented by the general formula [IV] and/or the general formula [V].

[IV]

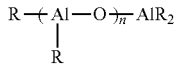

[V]

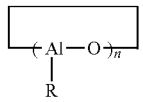

In the formulas [IV] and [V], R is a hydrocarbon group having 1 to 10 carbon atoms and n is an integer of 2 or more.

In particular, a methylaluminoxane wherein R is a methyl group and wherein n is 3 or more, preferably 10 or more, is used. These aluminoxanes may have a slight amount of organoaluminum compounds mixed thereinto.

When, in the present invention, ethylene and an α-olefin having three or more carbon atoms are copolymerized at high temperature, benzene-insoluble organoaluminum oxy compounds such as those exemplified in patent literature JP-A No. H02-78687 may also be applied. In addition, organoaluminum oxy compounds described in JP-A No. H02-167305, aluminoxanes having two or more kinds of alkyl groups described in JP-A No. H02-24701 and JP-A No. H03-103407, and the like may also be preferably utilized. The "benzene-insoluble organoaluminum oxy compound", which may be used in the present invention, has an Al content dissolved in benzene at 60° C. typically at 10% or less, preferably 5% or less, particularly preferably 2% or less based on the conversion to Al atoms, and is an insoluble or poorly-soluble compound to benzene.

Examples of the organoaluminum oxy compounds (b-2) also include modified methylaluminoxanes such as the one represented by the following general formula [VI].

[VI]

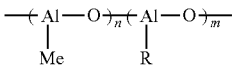

In the formula [VI], R is a hydrocarbon group having 1 to 10 carbon atoms and each of m and n is independently an integer of 2 or more.

This modified methylaluminoxane is prepared using trimethylaluminum and an alkylaluminum other than trimethylaluminum. Such a compound is generally referred to as MMAO. Such MMAO can be prepared by a method described in U.S. Pat. Nos. 4,960,878 and 5,041,584. A compound which is prepared using trimethylaluminum and triisobutylaluminum wherein R is an isobutyl group is also commercially available under the name of MMAO, TMAO, and the like from Tosoh Finechem Corporation. Such MMAO is an aluminoxane whose solubility with respect to various solvents and preservation stability have been improved, and is soluble in an aliphatic hydrocarbon or an alicyclic hydrocarbon, specifically unlike the compounds which are insoluble or poorly-soluble to benzene among the compounds represented by the formulas [IV] and [V].

Further, examples of the organoaluminum oxy compounds (b-2) also include boron-containing organoaluminum oxy compounds represented by the general formula [VII].

[VII]

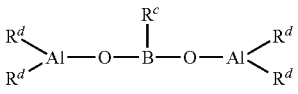

In the formula [VII], $R^c$ is a hydrocarbon group having 1 to 10 carbon atoms; and $R^d$ may each be the same or different and is a hydrogen atom, a halogen atom or a hydrocarbon group having 1 to 10 carbon atoms.

Examples of the compounds (b-3) capable of reacting with the bridged metallocene compound (a) to form an ion pair (hereinafter may be referred to as "ionized ionic compound" or simply "ionic compound" for short) include Lewis acids, ionic compounds, borane compounds and carborane compounds described in JP-A No. H01-501950, JP-A No. H01-502036, JP-A No. H03-179005, JP-A No. H03-179006, JP-A No. H03-207703, JP-A No. H03-207704, U.S. Pat. No. 5,321,106, and so on. Further examples include heteropoly compounds and isopoly compounds.

The ionized ionic compounds preferably used in the present invention are boron compounds represented by the following general formula [VIII].

[VIII]

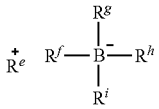

In the formula [VIII], $R^{e+}$ is $H^+$, carbenium cation, oxonium cation, ammonium cation, phsphonium cation, cycloheptyltrienyl cation, ferrocenium cation containing a transition metal, or the like. $R^f$ to $R^i$ may be the same as or different from each other and are each a substituent selected from hydrocarbon groups having 1 to 20 carbon atoms, silicon-containing groups, nitrogen-containing groups, oxygen-containing groups, halogen atoms and halogen-containing groups, and preferably a substituted aryl group.

Specific examples of the carbenium cations include trisubstituted carbenium cations, such as triphenylcarbenium cation, tris(4-methylphenyl)carbenium cation and tris(3,5-dimethylphenyl)carbenium cation.

Specific examples of the ammonium cations include trialkyl-substituted ammonium cations such as trimethylammonium cation, triethylammonium cation, tri(n-propyl)ammonium cation, triisopropylammonium cation, tri(n-butyl)ammonium cation and triisobutylammonium cation; N,N-dialkylanilinium cations such as N,N-dimethylanilinium cation, N,N-diethylanilinium cation and N,N-2,4,6-pentamethylanilinium cation; and dialkylammonium cations such as diisopropylammonium cation and dicyclohexylammonium cation.

Specific examples of the phosphonium cations include triarylphosphonium cations such as triphenylphosphonium cation, tris(4-methylphenyl)phosphonium cation and tris(3,5-dimethylphenyl)phosphonium cation.

Of the above specific examples, carbenium cation, ammonium cation and the like are preferable as $R^{e+}$, and in particular, triphenylcarbenium cation, N,N-dimethylanilinium cation and N,N-diethylanilium cation are preferable.

Examples of compounds containing carbenium cation, among the ionized ionic compounds preferably used in the present invention, include triphenylcarbenium tetraphenylborate, triphenylcarbenium tetrakis(pentafluorophenyl)borate, triphenylcarbenium tetrakis[3,5-di-(trifluoromethyl)phenyl]borate, tris(4-methylphenyl)carbenium tetrakis(pentafluorophenyl)borate and tris(3,5-dimethylphenyl)carbenium tetrakis(pentafluorophenyl)borate.

Examples of compounds containing a trialkyl-substituted ammonium cation, among the ionized ionic compounds preferably used in the present invention, include triethylammonium tetraphenylborate, tripropylammonium tetraphenylborate, tri(n-butyl)ammonium tetraphenylborate, trimethylammonium tetrakis(4-methylphenyl)borate, trimethylammonium tetrakis(2-methylphenyl)borate, tri(n-butyl)ammonium tetrakis(pentafluorophenyl)borate, triethylammonium tetrakis(pentafluorophenyl)borate, tripropylammonium tetrakis(pentafluorophenyl)borate, tripropylammonium tetrakis(2,4-dimethylphenyl)borate, tri(n-butyl)ammonium tetrakis(3,5-dimethylphenyl)borate, tri(n-butyl)ammonium tetrakis[4-(trifluoromethyl)phenyl]borate, tri(n-butyl)ammonium tetrakis[3,5-di(trifluoromethyl)phenyl]borate, tri(n-butyl)ammonium tetrakis(2-methylphenyl)

borate, dioctadecylmethylammonium tetraphenylborate, dioctadecylmethylammonium tetrakis(4-methylphenyl)borate, dioctadecylmethylammonium tetrakis(4-methylphenyl)borate, dioctadecylmethylammonium tetrakis(pentafluorophenyl)borate, dioctadecylmethylammonium tetrakis(2,4-dimethylphenyl)borate, dioctadecylmethylammonium tetrakis(3,5-dimethylphenyl)borate, dioctadecylmethylammonium tetrakis[4-(trifluoromethyl)phenyl]borate, dioctadecylmethylammonium tetrakis[3,5-di(trifluoromethyl)phenyl]borate and dioctadecylmethylammonium.

Examples of compounds containing a N,N-dialkylanilinium cation, among the ionized ionic compounds preferably used in the present invention, include N,N-dimethylanilinium tetraphenylborate, N,N-dimethylanilinium tetrakis(pentafluorophenyl)borate, N,N-dimethylanilinium tetrakis[3,5-di(trifluoromethyl)phenyl]borate, N,N-diethylanilinium tetraphenylborate, N,N-diethylanilinium tetrakis(pentafluorophenyl)borate, N,N-diethylanilinium tetrakis[3,5-di(trifluoromethyl)phenyl]borate, N,N-2,4,6-pentamethylanilinium tetraphenylborate and N,N-2,4,6-pentamethylanilinium tetrakis(pentafluorophenyl)borate.

Examples of compounds containing a dialkylammonium cation, among the ionized ionic compounds preferably used in the present invention, include di-n-propylammonium tetrakis(pentafluorophenyl)borate and dicyclohexylammonium tetraphenylborate.

Ionic compounds exemplified in JP-A No. 2004-51676 are also employable without any restriction.

The ionic compounds (b-3) may be used singly, or two or more kinds thereof may be mixed and used.

The organometallic compounds (b-1) are preferably trimethylaluminum, triethylaluminum and triisobutylaluminum, which are easily obtainable as commercial products. Of these, triisobutylaluminum, which is easy to handle, is particularly preferable.

The organoaluminum oxy compounds (b-2) are preferably methylaluminoxane, which is easily obtainable as a commercial product, and MMAO, which is prepared using trimethylaluminum and triisobutylaluminum. Among these, MMAO, whose solubility to various solvents and preservation stability have been improved, is particularly preferable.

The ionic compounds (b-3) are preferably triphenylcarbenium tetrakis(pentafluorophenyl)borate and N,N-dimethylanilinium tetrakis(pentafluorophenyl)borate, which are easily obtainable as commercial products and greatly contributory to improvement in polymerization activity.

As the compound (b), a combination of triisobutylaluminum and triphenylcarbenium tetrakis(pentafluorophenyl)borate, and a combination of triisobutylaluminum and N,N-dimethylanilinium tetrakis(pentafluorophenyl)borate are particularly preferable because the polymerization activity is markedly enhanced.

<Carrier (c)>

In the present invention, a carrier (c) may be used as a constituent of the olefin polymerization catalyst, when needed.

The carrier (c) that may be used in the present invention is an inorganic or organic compound and is a granular or fine particulate solid. Of such inorganic compounds, porous oxides, inorganic chlorides, clays, clay minerals or ion-exchanging layered compounds are preferable.

As the porous oxides, $SiO_2$, $Al_2O_3$, MgO, ZrO, $TiO_2$, $B_2O_3$, CaO, ZnO, BaO, $ThO_2$ and the like, and composites or mixtures containing these oxides, such as natural or synthetic zeolite, $SiO_2$—MgO, $SiO_2$—$Al_2O_3$, $SiO_2$—$TiO_2$, $SiO_2$—$V_2O_5$, $SiO_2$—$Cr_2O_3$ and $SiO_2$—$TiO_2$—MgO, can be specifically used. Of these, porous oxides containing $SiO_2$ and/or $Al_2O_3$ as a main component are preferable. Such porous oxides differ in their properties depending upon the type and the production process, but a carrier preferably used in the present invention has a particle diameter of 0.5 to 300 μm, preferably 1.0 to 200 μm, a specific surface area of 50 to 1000 $m^2/g$, preferably 100 to 700 $m^2/g$, and a pore volume of 0.3 to 3.0 $cm^3/g$. Such a carrier is used after it is calcined at 100 to 1000° C., preferably 150 to 700° C., when needed.

As the inorganic chlorides, $MgCl_2$, $MgBr_2$, $MnCl_2$, $MnBr_2$ or the like is used. The inorganic chloride may be used as it is, or may be used after pulverized by a ball mill or an oscillating mill. Further, fine particles obtained by dissolving an inorganic chloride in a solvent such as an alcohol and then precipitating it using a precipitant may be used.

The clay usually comprises a clay mineral that is a main component. The ion-exchanging layered compound is a compound having a crystal structure in which constituent planes lie one upon another in parallel and are bonded to each other by ionic bonding or the like with a weak bonding force, and the ions contained are exchangeable. Most of the clay minerals are ion-exchanging layered compounds. These clay, clay mineral and ion-exchanging layered compound are not limited to natural ones, and artificial synthetic products can be also used. Examples of the clays, the clay minerals and the ion-exchanging layered compounds include clays, clay minerals and ionic crystalline compounds having layered crystal structures such as hexagonal closest packing type, antimony type, $CdCl_2$ type and $CdI_2$ type. Examples of such clays and clay minerals include kaolin, bentonite, Kibushi clay, gairome clay, allophane, hisingerite, pyrophyllite, micas, montmorillonites, vermiculite, chlorites, palygorskite, kaolinite, nacrite, dickite and halloysite. Examples of the ion-exchanging layered compounds include crystalline acidic salts of polyvalent metals, such as α-Zr$(HAsO_4)_2$—$H_2O$, α-Zr$(HPO_4)_2$, α-Zr$(KPO_4)_2.3H_2O$, α-Ti$(HPO_4)_2$, α-Ti$(HAsO_4)_2.H_2O$, α-Sn$(HPO_4)_2.H_2O$, γ-Zr$(HPO_4)_2$, γ-Ti$(HPO_4)_2$ and γ-Ti$(NH_4PO_4)_2.H_2O$. It is also preferable to subject the clays and the clay minerals for use in the present invention to chemical treatment. Any chemical treatments such as surface treatments to remove impurities adhering to a surface and treatments having influence on the crystal structure of clay can be used. Specific examples of the chemical treatments include acid treatment, alkali treatment, salts treatment and organic substance treatment.

The ion-exchanging layered compound may be a layered compound in which spacing between layers has been enlarged by exchanging exchangeable ions present between layers with other large bulky ions. Such a bulky ion plays a pillar-like role to support a layer structure and is usually called pillar. Introduction of another substance (guest compound) between layers of a layered compound as above is referred to as "intercalation". Examples of the guest compounds include cationic inorganic compounds such as $TiCl_4$ and $ZrCl_4$, metallic alkoxides such as $Ti(OR)_4$, $Zr(OR)_4$, $PO(OR)_3$ and $B(OR)_3$ (R is a hydrocarbon group or the like), and metallic hydroxide ions such as $[Al_{13}O_4(OH)_{24}]^{7+}$, $[Zr_4(OH)_{14}]^{2+}$ and $[Fe_3O(OCOCH_3)_6]^+$. These compounds are used singly or in combination of two or more kinds. During intercalation of these compounds, polymerization products obtained by subjecting metallic alkoxides such as $Si(OR)_4$, $Al(OR)_3$ and $Ge(OR)_4$ (R is a hydrocarbon group or the like) to hydrolysis polycondensation, colloidal inorganic compounds such as $SiO_2$, etc. may be allowed to coexist. As the pillar, an oxide formed by intercalating the above metallic hydroxide ion between layers and then performing thermal dehydration, or the like can be mentioned.

Of the above carriers, preferable are clays and clay minerals, and particularly preferable are montmorillonite, vermiculite, pectolite, taeniolite and synthetic mica.

The organic compound functioning as the carrier (c) may be a granular or fine particulate solid having a particle diameter of 0.5 to 300 μm. Specific examples thereof include (co)polymers produced using, as a main component, an α-olefin having 2 to 14 carbon atoms such as ethylene, propylene, 1-butene and 4-methyl-1-pentene; (co)polymers produced using, as a main component, vinylcyclohexane or styrene; and modified products thereof.

The olefin polymerization catalyst used in the polymerization method disclosed in the present specification can afford an ethylene/α-olefin copolymer (B) having short blockwise sequences and thus allows the polymerization temperature to be increased. That is, the olefin polymerization catalyst can suppress the extension of blockwise sequences in the ethylene/α-olefin copolymer (B) that occurs at high polymerization temperature.

In solution polymerization, a polymerization solution including an ethylene/α-olefin copolymer (B) produced exhibits low viscosity when the temperature is high and thus the concentration of the ethylene/α-olefin copolymer (B) in the polymerizer can be increased as compared to when the polymerization takes place at a lower temperature. As a result, the productivity per polymerizer is enhanced. While the copolymerization of ethylene with α-olefins in the invention may be carried out by any of liquid-phase polymerization processes such as solution polymerization and suspension polymerization (slurry polymerization) and gas-phase polymerization processes, solution polymerization is particularly preferable because the greatest advantage can be taken of the effects of the invention.

The components of the olefin polymerization catalyst may be used in any manner and may be added in any order without limitation. At least two or more of the components for the catalyst may be placed in contact together beforehand.

The bridged metallocene compound (a) (hereinafter, also written as the "component (a)") is usually used in an amount of $10^{-9}$ to $10^{-1}$ mol, and preferably $10^{-8}$ to $10^{-2}$ mol per 1 L of the reaction volume.

The organometallic compound (b-1) (hereinafter, also written as the "component (b-1)") is usually used in such an amount that the molar ratio of the component (b-1) to the transition metal atoms (M) in the component (a) [(b-1)/M] is 0.01 to 50,000, and preferably 0.05 to 10,000.

The organoaluminum oxy compound (b-2) (hereinafter, also written as the "component (b-2)") is usually used in such an amount that the molar ratio of the aluminum atoms in the component (b-2) to the transition metal atoms (M) in the component (a) [(b-2)/M] is 10 to 5,000, and preferably 20 to 2,000.

The ionic compound (b-3) (hereinafter, also written as the "component (b-3)") is usually used in such an amount that the molar ratio of the component (b-3) to the transition metal atoms (M) in the component (a) [(b-3)/M] is 1 to 10,000, and preferably 1 to 5,000.

The polymerization temperature is usually −50° C. to 300° C., preferably 100° C. to 250° C., and more preferably 130° C. to 200° C. In this range of polymerization temperatures, the solution viscosity during the polymerization is decreased and the removal of polymerization heat is facilitated with increasing temperature. The polymerization pressure is usually normal pressure to 10 MPa in gauze pressure (MPa-G), and preferably normal pressure to 8 MPa-G.

The polymerization reaction may be performed batchwise, semi-continuously or continuously. The polymerization may be carried out continuously in two or more polymerizers under different reaction conditions.

The molecular weight of the copolymer to be obtained may be controlled by controlling the hydrogen concentration in the polymerization system or the polymerization temperature. Alternatively, the molecular weight may be controlled by controlling the amount of the component (b) used. When hydrogen is added, the appropriate amount thereof is about 0.001 to 5,000 NL per 1 kg of the copolymer produced.

The molecular weight distribution (Mw/Mn) of the copolymer (B) varies depending on the structure of the catalyst used. In the case of the bridged metallocene compound represented by the formula [I], the molecular weight distribution may be controlled by appropriately changing the substituents represented by $R^1$ to $R^{14}$. Alternatively, the molecular weight distribution may be controlled by removing low-molecular weight components from the polymer by a known method such as vacuum distillation.

By controlling of the molecular weight and molecular weight distribution of the copolymer (B), it is possible to control the peak top molecular weight of the copolymer (B) and the weight fraction of components having a molecular weight not less than 20,000 of the copolymer relative to all the components having a molecular weight not less than the peak top molecular weight (specifically, the ratio of the weight of the "components having a molecular weight not less than 20,000" to the weight of the "components having a molecular weight not less than the peak top molecular weight"). This weight fraction may be also controlled by combining a plurality of copolymers having different molecular weights or molecular weight distributions.

The polymerization solvent used in the liquid-phase polymerization process is usually an inert hydrocarbon solvent, and is preferably a saturated hydrocarbon having a boiling point of 50° C. to 200° C. under normal pressure. Specific examples of the polymerization solvents include aliphatic hydrocarbons such as propane, butane, pentane, hexane, heptane, octane, decane, dodecane and kerosine, and alicyclic hydrocarbons such as cyclopentane, cyclohexane and methylcyclopentane. Particularly preferred solvents are hexane, heptane, octane, decane and cyclohexane. The α-olefins themselves to be polymerized may be used as the polymerization solvents. Although aromatic hydrocarbons such as benzene, toluene and xylene and halogenated hydrocarbons such as ethylene chloride, chlorobenzene and dichloromethane are usable as the polymerization solvents, the use of these solvents is not preferable from the point of view of the reduction of environmental loads and in order to minimize the influence on the human body health.

The kinematic viscosity of olefin polymers at 100° C. depends on the molecular weight of the polymers. That is, high-molecular weight polymers exhibit a high viscosity whilst low-molecular weight polymers have a low viscosity. Thus, the kinematic viscosity at 100° C. is adjustable by controlling the molecular weight in the above-described manner. Further, the polymer obtained may be hydrogenated by a known method (hereinafter also written as "hydrogenation"). If double bonds in the obtained polymers are reduced by the hydrogenation, oxidation stability and heat resistance are enhanced.

When the copolymer (B) is produced so that the molar content of ethylene will be in the range of 30 to 70 mol % relative to the total of ethylene-derived structural units and α-olefin-derived structural units taken as 100 mol %, ethylene and an α-olefin having 3 to 20 carbon atoms that will be copolymerized together are usually fed in an ethylene:α-olefin molar ratio=10:90 to 99.9:0.1, preferably in an ethylene:α-olefin molar ratio=30:70 to 99.9:0.1, and more preferably in an ethylene:α-olefin molar ratio=50:50 to 99.9:0.1.

The ethylene/α-olefin copolymers (B) may be used singly, or two or more differing in molecular weight or molecular weight distribution or having different monomer compositions may be used in combination.

Functional groups in the ethylene/α-olefin copolymer (B) may be graft modified, and such a modified copolymer may be secondarily modified. For example, methods described in literature such as JP-A-S61-126120 and Japanese Patent No. 2593264 may be adopted. An example secondary modification method is described in JP-A-2008-508402.

⟨Lubricant Compositions⟩

The lubricant composition of the invention includes the lubricant base oil (A) and the ethylene/α-olefin copolymer (B) described hereinabove.

The lubricant composition of the invention has a kinematic viscosity at 100° C. of not more than 20 $mm^2/s$. If the kinematic viscosity at 100° C. of the lubricant composition exceeds 20 $mm^2/s$, the ability of the lubricant itself to keep the form of an oil film is increased and consequently full advantage cannot be taken of the present invention. Further, such a high viscosity deteriorates the fuel efficiency performance. The kinematic viscosity at 100° C. is more preferably not more than 16 $mm^2/s$, and still more preferably not more than 10 $mm^2/s$. In particular, high fuel efficiency performance and outstanding shear stability may be obtained at 7.5 $mm^2/s$ or less. This kinematic viscosity is a value measured by the method described in JIS K2283.

The lubricant composition of the invention has a peak top of molecular weight in the range of 3,000 to 10,000 as measured by gel permeation chromatography (GPC) in accordance with a method described later with reference to polystyrene standards, and has a 1 to 10% weight fraction of components having a molecular weight not less than 20,000 relative to all the components having a molecular weight not less than the molecular weight that gives the peak top (specifically, the fraction is a ratio of the weight of the "components having a molecular weight not less than 20,000" to the weight of the "components having a molecular weight not less than the molecular weight that gives the peak top"). (Hereinafter, the fraction will be also written simply as the "weight fraction of components having a molecular weight not less than 20,000".) This peak in the range of 3,000 to 10,000 molecular weights is mainly assigned to the ethylene/α-olefin copolymer (B). The above weight fraction in the lubricant composition may be controlled by controlling the weight fraction of components having a molecular weight not less than 20,000 of the ethylene/α-olefin copolymer (B).

The phrase "the lubricant composition (or a specific component) has a peak top in a specific range of molecular weights" means that a molecular weight distribution curve of the lubricant composition (or the specific component) has a maximum value of dw/dLog(M) (M is the molecular weight, and w is the weight fraction of the component having the corresponding molecular weight) in that range. The molecular weight giving this maximum value (hereinafter, also written as the "molecular weight at the peak top") is not necessarily consistent with the peak top molecular weight (specifically, the molecular weight that gives the highest maximum value of dw/dLog(M) in the entirety of the molecular weight distribution curve).

If the weight fraction of components having a molecular weight not less than 20,000 exceeds 10%, the shear stability of the lubricant composition of the invention is deteriorated sharply and significantly. The weight fraction is preferably not more than 6%, and more preferably not more than 5%. This range of the weight fraction ensures that outstanding shear stability will be obtained.

If, on the other hand, the weight fraction of components having a molecular weight not less than 20,000 is below 1%, sufficient low-temperature viscosity characteristics cannot be obtained. From the point of view of temperature viscosity characteristics, the weight fraction of components having a molecular weight not less than 20,000 is preferably not less than 2%, and more preferably not less than 2.5%.

In the lubricant composition of the invention, the ratio in which the lubricant base oil (A) and the ethylene/α-olefin copolymer (B) are blended is not particularly limited as long as the characteristics required for the target application are satisfied. The lubricant composition of the invention usually contains the lubricant base oil (A) and the ethylene/α-olefin copolymer (B) in a weight ratio ((A)/(B)) of 99/1 to 50/50.

The lubricating composition of the invention may contain additives such as extreme pressure additives, detergent dispersants, viscosity index improvers, antioxidants, corrosion inhibitors, antiwear agents, friction modifiers, pour-point depressants, antirust agents and antifoaming agents.

Examples of the additives used in the lubricating compositions of the invention include the following. These additives may be used singly, or two or more may be used in combination.

Extreme pressure additives are compounds that have an effect of preventing seizing when internal combustion engines or industrial machines are subjected to high load conditions, and are not particularly limited. Examples include sulfur-containing extreme pressure additives such as sulfides, sulfoxides, sulfones, thiophosphinates, thiocarbonates, sulfurized oils and fats, and sulfurized olefins; phosphoric acids such as phosphate esters, phosphite esters, phosphate ester amine salts and phosphite ester amine salts; and halogen compounds such as chlorinated hydrocarbons. Two or more of these compounds may be used in combination.

In some cases, hydrocarbons or other organic components constituting the lubricating composition may be carbonized by heat or shear before the extreme pressure lubrication conditions are reached, forming a carbide film on metal surfaces. Thus, the extreme pressure additive used alone may be prevented from sufficient contact with the metal surface due to such a carbide film, and the extreme pressure additive may fail to provide sufficient effects that are expected.

The extreme pressure additive may be added singly. However, in view of the fact that the lubricating composition of the invention consists primarily of saturated hydrocarbons such as the copolymer, an advantage in dispersibility may be obtained by adding the extreme pressure additive together with other additives in the dissolved state in a lubricant base oil such as a mineral oil or a synthetic hydrocarbon oil. Specifically, an extreme pressure additive package is more preferably added to the lubricating composition. The extreme pressure additive package is obtained by blending components including the extreme pressure additive component in advance and dissolving the blend into a lubricant base oil such as a mineral oil or a synthetic hydrocarbon oil.

Preferred examples of the extreme pressure additives (packages) include Anglamol-98A manufactured by LUBRIZOL, Anglamol-6043 manufactured by LUBRIZOL, HITEC 1532 manufactured by AFTON CHEMICAL, HITEC 307 manufactured by AFTON CHEMICAL, HITEC 3339 manufactured by AFTON CHEMICAL and Additin RC 9410 manufactured by RHEIN CHEMIE.

The extreme pressure additives are used as required in the range of 0 to 10 mass % relative to 100 mass % of the lubricating composition.

Examples of detergent dispersants include metal sulfonates, metal phenates, metal phosphanates and succinimide. The detergent dispersants are used as required in the range of 0 to 15 mass % relative to 100 mass % of the lubricating composition.

DI packages which include the dispersants and other additives in the dissolved state in lubricant oils such as mineral oils or synthetic hydrocarbon oils are available in industry. Examples thereof include HITEC 3419D manufactured by AFTON CHEMICAL and HITEC 2426 manufactured by AFTON CHEMICAL.

Examples of the antiwear agents include inorganic or organic molybdenum compounds such as molybdenum disulfide, graphite, antimony sulfide and polytetrafluoroethylene. The antiwear agents are used as required in the range of 0 to 3 mass % relative to 100 mass % of the lubricant composition.

Examples of the antioxidants include phenol compounds such as 2,6-di-t-butyl-4-methylphenol, and amine compounds. The antioxidants are used as required in the range of 0 to 3 mass % relative to 100 mass % of the lubricant composition.

Examples of the antirust agents include various amine compounds, metal carboxylate salts, polyhydric alcohol esters, phosphorus compounds and sulfonates. The antirust agents are used as required in the range of 0 to 3 mass % relative to 100 mass % of the lubricant composition.

Examples of the antifoaming agents include silicone compounds such as dimethylsiloxane and silica gel dispersions, alcohol compounds and ester compounds. The antifoaming agents are used as required in the range of 0 to 0.2 mass % relative to 100 mass % of the lubricant composition.

The pour-point depressants may be any of various known pour-point depressants. Specific examples include polymer compounds having organic acid ester groups. Vinyl polymers having organic acid ester groups are particularly suited. Examples of the vinyl polymers having organic acid ester groups include (co)polymers of alkyl methacrylates, (co)polymers of alkyl acrylates, (co)polymers of alkyl fumarates, (co)polymers of alkyl maleates and alkylated naphthalenes.

The pour-point depressants have a melting point of not more than −13° C., preferably −15° C., and more preferably not more than −17° C. The melting point of the pour-point depressants is measured with a differential scanning calorimeter (DSC). Specifically, approximately 5 mg of the sample is placed into an aluminum pan, heated to 200° C., held at 200° C. for 5 minutes, cooled to −40° C. at 10° C./min, held at −40° C. for 5 minutes, and heated at 10° C./min, and the endothermic curve obtained during the second heating is analyzed to determine the melting point.

The pour-point depressants have a weight average molecular weight in the range of 20,000 to 400,000, preferably 30,000 to 300,000, and more preferably in the range of 40,000 to 200,000 as measured by gel permeation chromatography relative to standard polystyrenes.

The pour-point depressants are usually used in the range of 0 to 2 mass % relative to 100 mass % of the lubricant composition.

In addition to the additives described hereinabove, other additives such as demulsifying agents, colorants and oiliness agents (oiliness improvers) may be used as required.

⟨Uses⟩

The lubricant compositions of the invention may be used as industrial lubricants (gear oils and hydraulic oils) and base oils for greases, and are suited as automotive lubricants. Further, the compositions may be suitably used for automotive gear oils such as differential gear oils, and automotive drive oils such as manual transmission oils, automatic transmission oils, continuously variable transmission oils and dual clutch transmission oils. Furthermore, the compositions may be used for automotive engine oils and marine cylinder oils. The kinematic viscosity at 100° C. of the lubricant composition of the invention, in particular as an automotive low-viscosity transmission oil, can be controlled to not more than 7.5 $mm^2/s$. Excellent fuel efficiency performance can be attained by further controlling the kinematic viscosity to not more than 6.5 $mm^2/s$, or more preferably to not more than 5.5 $mm^2/s$.

EXAMPLES

The present invention will be described in further detail based on Examples hereinbelow without limiting the scope of the invention to such Examples.

[Evaluation Methods]

In the following description such as Examples and Comparative Examples, properties and characteristics of ethylene/α-olefin copolymers and lubricant compositions were measured by the following methods.

⟨Ethylene Content (Mol %)⟩

With Fourier transform infrared spectrophotometer FT/IR-610 or FT/IR-6100 manufactured by JASCO Corporation, the absorbance ratio ($D1155\ cm^{-1}/D721\ cm^{-1}$) of the absorption near 1155 $cm^{-1}$ based on the framework vibration of propylene to the absorption near 721 $cm^{-1}$ based on the transverse vibration of long-chain methylene groups was calculated. The ethylene content (wt %) was determined based on a calibration curve prepared beforehand (using standard samples in accordance with ASTM D3900). Next, the ethylene content (mol %) was determined using the following equation based on the ethylene content (wt %) obtained above.

$$\text{Ethylene content (mol \%)} = \frac{[\text{Ethylene content (wt \%)} \div 28]}{[\text{Ethylene content (wt \%)} \div 28] + [\text{Propylene content (wt \%)} \div 42]}$$

⟨Value B⟩

A $^{13}C$-NMR dbenzene/benzene-$d_6$ (4/1 [vol/vol %]) as a measurement solvent at a measurement temperature of 120° C., a spectrum width of 250 ppm, a pulse repetition time of 5.5 sec and a pulse width of 4.7·μsec (45° pulse) (100 MHz, ECX400P manufactured by JEOL Ltd.) or at a measurement temperature of 120° C., a spectrum width of 250 ppm, a pulse repetition time of 5.5 sec and a pulse width of 5.0·μsec (45° pulse) (125 MHz, AVANCE III cryo-500 manufactured by Bruker BioSpin K.K.). The value B was calculated based on the equation [1] below.

$$B = \frac{P_{OE}}{2P_O \cdot P_E} \quad [1]$$

In the equation [1], $P_E$ is the molar fraction of ethylene components, $P_O$ is the molar fraction of α-olefin components, and $P_{OE}$ is the molar fraction of ethylene.α-olefin sequences relative to all the dyad sequences.

⟨GPC Measurement⟩

GPC measurement was performed using HLC-8320GPC manufactured by TOSOH CORPORATION in the following manner. TSKgel SuperMultipore HZ-M (four columns) were used as separation columns. The column temperature was 40° C. Tetrahydrofuran (manufactured by Wako Pure Chemical Industries, Ltd.) was used as a mobile phase. The developing speed was 0.35 ml/min. The sample concentration was 5.5 g/L. The sample injection amount was 20 μL. A differential refractometer was used as a detector. Standard polystyrenes manufactured by TOSOH CORPORATION (PStQuick MP-M) were used. The peak top molecular weight of the ethylene/α-olefin copolymer, and the molecular weight at the peak top in the range of 3,000 to 10,000 molecular weights of the lubricant composition were calculated based on a molecular weight distribution curve (GPC chart) prepared with reference to the standard polystyrenes in accordance with general calibration procedures.

The weight fractions of components having a molecular weight not less than 20,000 in the ethylene/α-olefin copolymer (B), the poly-α-olefin and the lubricant composition were determined by fractionating the region defined by the GPC chart and the baseline, and calculating the weight fraction of components having a molecular weight not less than 20,000 relative to all the components having a molecular weight not less than the molecular weight at the peak top in the range of 3,000 to 10,000 molecular weights, based on the areas of the fractionated regions.

⟨Number of Double Bonds in Molecular Chains⟩

A $^1$H-NMR spectrum was measured in o-dichlorobenzene-$d_4$ as a measurement solvent at a measurement temperature of 120° C., a spectrum width of 20 ppm, a pulse repetition time of 7.0 sec and a pulse width of 6.15 μsec (45° pulse) (400 MHz, ECX400P manufactured by JEOL Ltd.). The peak of the solvent (orthodichlorobenzene, 7.1 ppm) was used as the chemical shift reference. The ratio of the integral of a double bond peak observed at 4 to 6 ppm to the main peak observed at 0 to 3 ppm was calculated to determine the number of double bonds per 1000 carbon atoms (number/1000 C) (in the specification, written as the "number of double bonds in the molecular chains").

⟨Melting Point⟩

X-DSC-7000 manufactured by Seiko Instruments Inc. was used. Approximately 8 mg of the ethylene/α-olefin copolymer was placed into a readily closable aluminum sample pan, and the pan was arranged in the DSC cell. In a nitrogen atmosphere, the DSC cell was heated from room temperature to 150° C. at 10° C./min and was held at 150° C. for 5 minutes. Thereafter, the DSC cell was cooled to −100° C. at 10° C./min (cooling process). Next, the cell was held at −100° C. for 5 minutes and was heated at 10° C./min. With respect to the enthalpy curves recorded during these processes, the presence or absence of an endothermic or exothermic peak was determined. The copolymer was regarded as having no melting point (Tm) when there was no peaks or when the heat of fusion (ΔH) was not more than 1 J/g. The determination of the melting point (Tm) and the heat of fusion (ΔH) was based on JIS K7121.

⟨Chlorine Content⟩

ICS-1600 manufactured by Thermo Fisher Scientific Inc. was used. The ethylene/α-olefin copolymer was placed into a sample boat and was combusted and decomposed in a stream of Ar/$O_2$ at a combustion furnace preset temperature of 900° C. The gas generated was absorbed into an absorbent liquid, and the amount of chlorine was determined by ion chromatography.

⟨Viscosity Characteristics⟩

The kinematic viscosity at 100° C. and the viscosity index were measured and calculated by the method described in JIS K2283.

⟨Shear Test⟩

The shear stability of the lubricant composition was evaluated with a KRL shear tester in accordance with the method described in CRC L-45-T-93. The test time was increased from the described length of 20 hours to 100 hours. The rate of viscosity drop under shear conditions by the shear test at a test temperature of 60° C. and a bearing rotational speed of 1450 rpm was evaluated using the following equation.

Rate of viscosity drop by shear test (%)=(Kinematic viscosity at 100° C. before shearing−Kinematic viscosity at 100° C. after shearing)/Kinematic viscosity at 100° C. before shearing×100

⟨Viscosity at −40° C.⟩

As low-temperature viscosity characteristics, the viscosity at −40° C. was measured at −40° C. with a Brookfield viscometer in accordance with ASTM D2983.

[Production of Ethylene/α-Olefin Copolymers (B)]

Ethylene/α-olefin copolymers (B) were produced in accordance with Polymerization Examples described later. Where necessary, the ethylene/α-olefin copolymers (B) obtained were hydrogenated by the following method.

⟨Hydrogenation Process⟩

A 1 L-volume stainless steel autoclave was loaded with 100 mL of a hexane solution of a 0.5 mass % Pd/alumina catalyst and 500 mL of a 30 mass % hexane solution of the ethylene/α-olefin copolymer. After being tightly closed, the autoclave was purged with nitrogen. Next, the temperature was increased to 140° C. while performing stirring and the system was purged with hydrogen. The pressure was raised with hydrogen to 1.5 MPa and the hydrogenation reaction was performed for 15 minutes.

⟨Synthesis of Metallocene Compound⟩

Bis($\eta^5$-1,3-dimethylcyclopentadienyl)zirconium dichloride was synthesized by the method described in JP—B-H06-62642.

⟨Synthetic Example 1⟩ Synthesis of [methylphenylmethylene($\eta^5$-cyclopentadienyl) ($\eta^5$-2,7-di-t-butylfluorenyl)]zirconium dichloride (i) Synthesis of 6-methyl-6-phenylfulvene In a nitrogen atmosphere, a 200 mL three-necked flask was loaded with 7.3 g (101.6 mmol) of lithium cyclopentadiene and 100 mL of dehydrated tetrahydrofuran. The mixture was stirred. The resultant solution was cooled in an ice bath, and 15.0 g (111.8 mmol) of acetophenone was added dropwise. The mixture was stirred at room temperature for 20 hours. The resultant solution was quenched with an aqueous diluted hydrochloric acid solution. 100 mL of hexane was added, and soluble components were extracted. The organic phase was then washed with water and saturated brine and was dried with anhydrous magnesium sulfate. Thereafter, the solvent was distilled off, and the resultant viscous liquid was separated by column chromatography (hexane) to give the target product (a red viscous liquid).

(ii) Synthesis of methyl(cyclopentadienyl)(2,7-di-t-butylfluorenyl)(phenyl)methane In a nitrogen atmosphere, a 100 mL three-necked flask was loaded with 2.01 g (7.20 mmol) of 2,7-di-t-butylfluorene and 50 mL of dehydrated t-butyl methyl ether. While performing cooling in an ice bath, 4.60 mL (7.59 mmol) of a n-butyllithium/hexane solution (1.65 M) was added gradually. The mixture was stirred at room temperature for 16 hours. Further, 1.66 g (9.85 mmol) of 6-methyl-6-phenylfulvene was added, and the mixture was stirred for 1 hour while performing heating under reflux. While performing cooling in an ice bath, 50 mL of water was added gradually. The resultant two-phase solution was transferred to a 200 mL separatory funnel. After 50 mL of diethyl ether had been added, the funnel was shaken several times and the aqueous phase was removed. The organic phase was washed with 50 mL of water three times and with 50 mL of saturated brine one time. The liquid was dried with anhydrous magnesium sulfate for 30 minutes and thereafter the solvent was distilled off under reduced pressure. A small amount of hexane was added, and the solution was ultrasonicated. The resultant solid precipitate was recovered, washed with a small amount of hexane, and dried under reduced pressure to give 2.83 g of methyl(cyclopentadienyl)(2,7-di-t-butylfluorenyl)(phenyl)methane as a white solid.

(iii) Synthesis of [methylphenylmethylene($\eta^5$-cyclopentadienyl)($\eta^5$-2,7-di-t-butylfluorenyl)]zirconium dichloride To a 100 mL Schlenk flask, 1.50 g (3.36 mmol) of methyl(cyclopentadienyl)(2,7-di-t-butylfluorenyl) (phenyl) m ethane, 50 mL of dehydrated toluene and 570 μL (7.03 mmol) of THF were added sequentially in a nitrogen atmosphere. While performing cooling in an ice bath, 4.20 mL (6.93 mmol) of a n-butyllithium/hexane solution (1.65 M) was added gradually. The mixture was stirred at 45° C. for 5 hours. The solvent was distilled off under reduced pressure, and 40 mL of dehydrated diethyl ether was added. The addition resulted in a red solution. While performing cooling in a methanol/dry ice bath, 728 mg (3.12 mmol) of zirconium tetrachloride was added. Stirring was performed for 16 hours while increasing the temperature gradually to room temperature, resulting in a red orange slurry. The solvent was distilled off under reduced pressure. In a glove box, the resultant solid was washed with hexane and was extracted with dichloromethane. The extract was concentrated by distilling off the solvent under reduced pressure. A small amount of hexane was added to the concentrate, and the mixture was allowed to stand at −20° C. The resultant red orange solid precipitate was washed with a small amount of hexane and was dried under reduced pressure. Consequently, 1.20 g of [methylphenylmethylene($\eta^5$-cyclopentadienyl)($\eta^5$-2,7-di-t-butylfluorenyl)]zirconium dichloride was obtained as a red orange solid.

Polymerization Example 1

A 2 L-volume stainless steel autoclave that had been thoroughly purged with nitrogen was loaded with 760 mL of heptane and 120 g of propylene. After the temperature of the system had been increased to 150° C., the total pressure was increased to 3 MPaG by supplying hydrogen at 0.85 MPa and ethylene at 0.19 MPa. Next, 0.4 mmol of triisobutylaluminum, 0.0002 mmol of [methylphenylmethylene($\eta^5$-cyclopentadienyl)($\eta^5$-2,7-di-t-butylfluorenyl)]zirconium dichloride and 0.002 mmol of N,N-dimethylanilinium tetrakis(pentafluorophenyl)borate were injected with nitrogen. The mixture was stirred at a rotational speed of 400 rpm. The polymerization was thus initiated. The polymerization was performed at 150° C. for 5 minutes while keeping the total pressure at 3 MPaG by continuously supplying ethylene. The polymerization was terminated by the addition of a small amount of ethanol to the system. Unreacted ethylene, propylene and hydrogen were purged. The polymer solution obtained was washed with 1000 mL of 0.2 mol/L hydrochloric acid three times and with 1000 mL of distilled water three times, and was dried with magnesium sulfate. The solvent was distilled off under reduced pressure. The polymer was dried at 80° C. under reduced pressure for 10 hours. Next, hydrogenation was performed. A polymer 1 was thus obtained.

In the polymer 1, the number of double bonds in the molecular chains was less than 0.1 per 1000 C and the chlorine content was less than 0.1 ppm. The polymer 1 had an ethylene content of 48.5 mol %, a peak top molecular weight of 5,218, a weight fraction of components having a molecular weight not less than 20,000 of 1.22% relative to all components having a molecular weight not less than the peak top molecular weight, a value B of 1.2 and a kinematic viscosity at 100° C. of 155 $mm^2/s$. No melting point (melting peak) was observed.

Polymerization Example 2

A 2 L-volume stainless steel autoclave that had been thoroughly purged with nitrogen was loaded with 750 mL of heptane and 125 g of propylene. After the temperature of the system had been increased to 150° C., the total pressure was increased to 3 MPaG by supplying hydrogen at 0.69 MPa and ethylene at 0.23 MPa. Next, 0.4 mmol of triisobutylaluminum, 0.0001 mmol of [methylphenylmethylene($\eta^5$-cyclopentadienyl)($\eta^5$-2,7-di-t-butylfluorenyl)]zirconium dichloride and 0.001 mmol of N,N-dimethylanilinium tetrakis(pentafluorophenyl)borate were injected with nitrogen. The mixture was stirred at a rotational speed of 400 rpm. The polymerization was thus initiated. The polymerization was performed at 150° C. for 5 minutes while keeping the total pressure at 3 MPaG by continuously supplying ethylene alone. The polymerization was terminated by the addition of a small amount of ethanol to the system. Unreacted ethylene, propylene and hydrogen were purged. The polymer solution obtained was washed with 1000 mL of 0.2 mol/L hydrochloric acid three times and with 1000 mL of distilled water three times, and was dried with magnesium sulfate. The solvent was distilled off under reduced pressure. The polymer was dried at 80° C. under reduced pressure overnight. The thus-obtained ethylene-propylene copolymer weighing 52.2 g was hydrogenated. In this manner, a polymer 2 was obtained.

In the polymer 2, the number of double bonds in the molecular chains was less than 0.1 per 1000 C and the chlorine content was less than 0.1 ppm. The polymer 2 had an ethylene content of 49.7 mol %, a peak top molecular weight of 6,186, a weight fraction of components having a molecular weight not less than 20,000 of 2.92% relative to all components having a molecular weight not less than the peak top molecular weight, a value B of 1.2 and a kinematic viscosity at 100° C. of 281 $mm^2/s$. No melting point (melting peak) was observed.

Polymerization Example 3

A 2 L-volume stainless steel autoclave that had been thoroughly purged with nitrogen was loaded with 710 mL of heptane and 145 g of propylene. After the temperature of the system had been increased to 150° C., the total pressure was increased to 3 MPaG by supplying hydrogen at 0.43 MPa and ethylene at 0.26 MPa. Next, 0.4 mmol of triisobutylaluminum, 0.0001 mmol of [methylphenylmethylene($\eta^5$-cyclopentadienyl)($\eta^5$-2,7-di-t-butylfluorenyl)]zirconium dichloride and 0.001 mmol of N,N-dimethylanilinium tetrakis(pentafluorophenyl)borate were injected with nitrogen. The mixture was stirred at a rotational speed of 400 rpm. The polymerization was thus initiated. The polymerization was performed at 150° C. for 5 minutes while keeping the total pressure at 3 MPaG by continuously supplying ethylene. The polymerization was terminated by the addition of a small amount of ethanol to the system. Unreacted ethylene, propylene and hydrogen were purged. The polymer solution obtained was washed with 1000 mL of 0.2 mol/L hydrochloric acid three times and with 1000 mL of distilled water three times, and was dried with magnesium sulfate. The solvent was distilled off under reduced pressure. The polymer was dried at 80° C. under reduced pressure for 10 hours. Next, hydrogenation was performed. A polymer 3 was thus obtained.

In the polymer 3, the number of double bonds in the molecular chains was less than 0.1 per 1000 C and the chlorine content was less than 0.1 ppm. The polymer 3 had an ethylene content of 50.4 mol %, a peak top molecular weight of 7,015, a weight fraction of components having a molecular weight not less than 20,000 of 5.24% relative to all components having a molecular weight not less than the peak top molecular weight, a value B of 1.2 and a kinematic viscosity at 100° C. of 411 $mm^2/s$. No melting point (melting peak) was observed.

Polymerization Example 4

A 2 L-volume stainless steel autoclave that had been thoroughly purged with nitrogen was loaded with 910 mL of heptane and 45 g of propylene. After the temperature of the system had been increased to 130° C., the total pressure was increased to 3 MPaG by supplying hydrogen at 2.24 MPa and ethylene at 0.09 MPa. Next, 0.4 mmol of triisobutylaluminum, 0.0006 mmol of [methylphenylmethylene($\eta^5$-cyclopentadienyl) ($\eta^5$-2,7-di-t-butylfluorenyl)]zirconium dichloride and 0.006 mmol of N,N-dimethylanilinium tetrakis(pentafluorophenyl)borate were injected with nitrogen. The mixture was stirred at a rotational speed of 400 rpm. The polymerization was thus initiated. The polymerization was performed at 130° C. for 5 minutes while keeping the total pressure at 3 MPaG by continuously supplying ethylene alone. The polymerization was terminated by the addition of a small amount of ethanol to the system. Unreacted ethylene, propylene and hydrogen were purged. The polymer solution obtained was washed with 1000 mL of 0.2 mol/L hydrochloric acid three times and with 1000 mL of distilled water three times, and was dried with magnesium sulfate. The solvent was distilled off under reduced pressure. The polymer was dried at 80° C. under reduced pressure overnight. With thin-film evaporator model 2-03 manufactured by Shinko Pantec Co., Ltd., thin-film distillation was performed at a preset temperature of 180° C. and a flow rate of 3.1 mL/min while maintaining the degree of vacuum at 400 Pa. Consequently, an ethylene-propylene copolymer weighing 22.2 g was obtained. Next, hydrogenation was performed. A polymer 4 was thus obtained.

In the polymer 4, the number of double bonds in the molecular chains was less than 0.1 per 1000 C and the chlorine content was less than 0.1 ppm. The polymer 4 had an ethylene content of 51.9 mol %, a peak top molecular weight of 2,572, a weight fraction of components having a molecular weight not less than 20,000 of 0.05% relative to all components having a molecular weight not less than the peak top molecular weight, a value B of 1.2 and a kinematic viscosity at 100° C. of 40 $mm^2/s$. No melting point (melting peak) was observed.

Polymerization Example 5

A 2 L-volume continuous polymerizer equipped with a stirring blade and thoroughly purged with nitrogen was loaded with 1 L of dehydrated and purified hexane. Subsequently, a 96 mmol/L hexane solution of ethylaluminum sesquichloride ($Al(C_2H_5)_{1.5}.Cl_{1.5}$) was continuously fed at a rate of 500 mL/h for 1 hour. Further, there were continuously fed a 16 mmol/L hexane solution of $VO(OC_2H_5)Cl_2$ as a catalyst at a rate of 500 mL/h, and hexane at a rate of 500 mL/h. At the same time, the polymerization liquid was continuously withdrawn from an upper portion of the polymerizer so that the volume of the polymerization liquid in the polymerizer was kept constant at 1 L. Next, 35 L/h ethylene gas, 35 L/h propylene gas and 80 L/h hydrogen gas were supplied through bubbling tubes. The copolymerization reaction was performed at 35° C. while circulating a refrigerant through a jacket fitted to the exterior of the polymerizer. The polymerization solution which included an ethylene-propylene copolymer obtained under the above conditions was washed with 100 mL of 0.2 mol/L hydrochloric acid three times and with 100 mL of distilled water three times, and was dried with magnesium sulfate. The solvent was distilled off under reduced pressure. The polymer was dried at 130° C. under reduced pressure overnight.

The polymer 5 (ethylene-propylene copolymer) obtained by the above process had an ethylene content of 54.9 mol %, a peak top molecular weight of 4,031, a weight fraction of components having a molecular weight not less than 20,000 of 0.32% relative to all components having a molecular weight not less than the peak top molecular weight, a value B of 1.2 and a kinematic viscosity at 100° C. of 102 $mm^2/s$. No melting point (melting peak) was observed. The number of double bonds in the molecular chains was 0.1 per 1000 C, and the chlorine content was 15 ppm.

Polymerization Example 6

A 2 L-volume stainless steel autoclave that had been thoroughly purged with nitrogen was loaded with 710 mL of heptane and 145 g of propylene. After the temperature of the system had been increased to 150° C., the total pressure was increased to 3 MPaG by supplying hydrogen at 0.40 MPa and ethylene at 0.27 MPa. Next, 0.4 mmol of triisobutylaluminum, 0.0001 mmol of [methylphenylmethylene($\eta^5$-cyclopentadienyl) ($\eta^5$-2,7-di-t-butylfluorenyl)]zirconium dichloride and 0.001 mmol of N,N-dimethylanilinium tetrakis(pentafluorophenyl)borate were injected with nitrogen. The mixture was stirred at a rotational speed of 400 rpm. The polymerization was thus initiated. The polymerization was performed at 150° C. for 5 minutes while keeping the total pressure at 3 MPaG by continuously supplying ethylene alone. The polymerization was terminated by the addition of a small amount of ethanol to the system. Unreacted ethylene, propylene and hydrogen were purged. The polymer solution obtained was washed with 1000 mL of 0.2 mol/L hydrochloric acid three times and with 1000 mL of distilled water three times, and was dried with magnesium sulfate. The solvent was distilled off under reduced pressure. The polymer was dried at 80° C. under reduced pressure overnight. The thus-obtained ethylene-propylene copolymer weighing 52.2 g was hydrogenated. In this manner, a polymer 6 was obtained.

In the polymer 6, the number of double bonds in the molecular chains was less than 0.1 per 1000 C and the chlorine content was less than 0.1 ppm. The polymer 6 had an ethylene content of 53.1 mol %, a peak top molecular weight of 8,250, a weight fraction of components having a molecular weight not less than 20,000 of 12.90% relative to all components having a molecular weight not less than the peak top molecular weight, a value B of 1.2 and a kinematic viscosity at 100° C. of 608 $mm^2/s$. No melting point (melting peak) was observed.

Polymerization Example 7

A 2 L-volume continuous polymerizer equipped with a stirring blade and thoroughly purged with nitrogen was loaded with 1 L of dehydrated and purified hexane. Subsequently, a 96 mmol/L hexane solution of ethylaluminum sesquichloride ($Al(C_2H_5)_{1.5}.Cl_{1.5}$) was continuously fed at a rate of 500 mL/h for 1 hour. Further, there were continuously fed a 16 mmol/L hexane solution of $VO(OC_2H_5)Cl_2$ as a catalyst at a rate of 500 mL/h, and hexane at a rate of 500 mL/h. At the same time, the polymerization liquid was continuously withdrawn from an upper portion of the polymerizer so that the volume of the polymerization liquid in the polymerizer was kept constant at 1 L. Next, 47 L/h ethylene gas, 47 L/h propylene gas and 20 L/h hydrogen gas were supplied through bubbling tubes. The copolymerization reaction was performed at 35° C. while circulating a refrigerant through a jacket fitted to the exterior of the polymerizer. The polymerization solution which included an ethylene-propylene copolymer obtained under the above conditions was washed with 100 mL of 0.2 mol/L hydrochloric acid three times and with 100 mL of distilled water three times, and was dried with magnesium sulfate. The solvent was distilled off under reduced pressure. The polymer was dried at 130° C. under reduced pressure overnight.

The polymer 7 (ethylene-propylene copolymer) obtained by the above process had an ethylene content of 54.9 mol %, a peak top molecular weight of 12,564, a weight fraction of components having a molecular weight not less than 20,000 of 44.15% relative to all components having a molecular weight not less than the peak top molecular weight, a value B of 1.2 and a kinematic viscosity at 100° C. of 2,040 $mm^2/s$. No melting point (melting peak) was observed. The number of double bonds in the molecular chains was 0.1 per 1000 C, and the chlorine content was 8 ppm.

Polymerization Example 8

A 2 L-volume stainless steel autoclave that had been thoroughly purged with nitrogen was loaded with 190 mL of heptane and 405 g of propylene. After the temperature of the system had been increased to 80° C., the total pressure was increased to 3 MPaG by supplying 100 Nml of hydrogen and ethylene at 0.20 MPa. Next, 0.4 mmol of triisobutylaluminum, 0.0003 mmol of bis($\eta^5$-1,3-dimethylcyclopentadienyl) zirconium dichloride and 0.003 mmol of N,N-dimethylanilinium tetrakis(pentafluorophenyl)borate were injected with nitrogen. The mixture was stirred at a rotational speed of 400 rpm. The polymerization was thus initiated. The polymerization was performed at 80° C. for 5 minutes while keeping the total pressure at 3 MPaG by continuously supplying ethylene. The polymerization was terminated by the addition of a small amount of ethanol to the system. Unreacted ethylene, propylene and hydrogen were purged. The polymer solution obtained was washed with 1000 mL of 0.2 mol/L hydrochloric acid three times and with 1000 mL of distilled water three times, and was dried with magnesium sulfate. The solvent was distilled off under reduced pressure. The polymer was dried at 80° C. under reduced pressure for 10 hours. Next, hydrogenation was performed. A polymer 8 was thus obtained.

In the polymer 8, the number of double bonds in the molecular chains was less than 0.1 per 1000 C and the chlorine content was less than 0.1 ppm. The polymer 8 had an ethylene content of 52.2 mol %, a peak top molecular weight of 6,401, a weight fraction of components having a molecular weight not less than 20,000 of 12.97% relative to all components having a molecular weight not less than the peak top molecular weight, a value B of 1.2 and a kinematic viscosity at 100° C. of 408 $mm^2/s$. No melting point (melting peak) was observed.

TABLE 1

| | | Poly. Ex. 1 Polymer 1 | Poly. Ex. 2 Polymer 2 | Poly. Ex. 3 Polymer 3 | Poly. Ex. 4 Polymer 4 | Poly. Ex. 5 Polymer 5 | Poly. Ex. 6 Polymer 6 |
|---|---|---|---|---|---|---|---|
| Peak top molecular weight | | 5,218 | 6,186 | 7,015 | 2,572 | 4,031 | 8,250 |
| Melting peak | | Nil | Nil | Nil | Nil | Nil | Nil |
| Molar fraction of ethylene components | mol % | 48.5 | 49.7 | 50.4 | 51.9 | 54.9 | 53.1 |
| Value B | | 1.2 | 1.2 | 1.2 | 1.2 | 1.2 | 1.2 |
| Kinematic viscosity at 100° C. | $mm^2/s$ | 155 | 281 | 411 | 40 | 102 | 608 |
| Weight fraction of components having a molecular weight not less than 20,000 relative to all components having molecular weight not less than peak top molecular weight | % | 1.22 | 2.92 | 5.24 | 0.05 | 0.32 | 12.9 |

TABLE 1-continued

| | | Poly. Ex. 7 Polymer 7 | Poly. Ex. 8 Polymer 8 | PAO-100 | mPAO-100 | mPAO-300 |
|---|---|---|---|---|---|---|
| Peak top molecular weight | | 12,564 | 6,401 | 4,325 | 5,202 | 7,229 |
| Melting peak | | Nil | Nil | | | Nil |
| Molar fraction of ethylene components | mol % | 54.9 | 52.2 | | | |
| Value B | | 1.2 | 1.2 | | | |
| Kinematic viscosity at 100° C. | $mm^2/s$ | 2040 | 408 | 100 | 100 | 302 |
| Weight fraction of components having a molecular weight not less than 20,000 relative to all components having molecular weight not less than peak top molecular weight | % | 44.15 | 12.97 | 0.2 | 0.22 | 5.45 |

[Preparation of Lubricant Compositions]

In the preparation of lubricant compositions described below, the following components were used in addition to the ethylene/α-olefin copolymers (B).

Lubricant Base Oils:

synthetic hydrocarbon oil PAO (NEXBASE 2006 manufactured by NESTE, PAO-6) having a kinematic viscosity at 100° C. of 5.8 $mm^2/s$, API (American Petroleum Institute) Group II mineral oil (NEXBASE 3030 manufactured by NESTE, mineral oil-A) having a kinematic viscosity at 100° C. of 3.0 $mm^2/s$, and fatty acid ester diisodecyl adipate (DIDA) manufactured by DAIHACHI CHEMICAL INDUSTRY CO., LTD.

Extreme pressure additive package: ANGLAMOL-98A (EP) manufactured by LUBRIZOL.

Pour-point depressant: IRGAFLO 720P (PPD) manufactured by BASF.

The following were used as poly-α-olefins.

PAO-100: PAO obtained from an α-olefin with 6 or more carbon atoms as a monomer using an acid catalyst, and having a kinematic viscosity at 100° C. of 100 $mm^2/s$, a peak top molecular weight of 4,325 and a weight fraction of components having a molecular weight not less than 20,000 of 0.20% relative to all components having a molecular weight not less than the peak top molecular weight (Spectrasyn 100 manufactured by ExxonMobil Chemical).

mPAO-100: PAO obtained from 1-decene as a monomer using a metallocene catalyst, and having a kinematic viscosity at 100° C. of 100 $mm^2/s$, a peak top molecular weight of 5,202 and a weight fraction of components having a molecular weight not less than 20,000 of 0.22% relative to all components having a molecular weight not less than the peak top molecular weight (Durasyn 180R manufactured by INEOS Oligomers).

mPAO-300: PAO obtained from 1-octene as a monomer using a metallocene catalyst, and having a kinematic viscosity at 100° C. of 302 $mm^2/s$, a peak top molecular weight of 7,229 and a weight fraction of components having a molecular weight not less than 20,000 of 5.45% relative to all components having a molecular weight not less than the peak top molecular weight. This polymer was obtained in accordance with the method described in Polymerization Example 1 in WO 2011/142345. No melting point (melting peak) was observed.

⟨Automotive Gear Oils⟩

In Examples 1 to 3, the formulations were designed so that the kinematic viscosity at 100° C. would be about 14 $mm^2/s$ to meet Society of Automobile Engineers (SAE) Gear Oil Viscosity Grade 90. Table 2 sets forth the formulations and lubricant characteristics of the lubricant compositions obtained in Examples and Comparative Examples described below. This viscosity grade is suitably used for such lubricants as automotive differential gear oils, and manual transmission oils for trucks and buses.

Example 1

A lubricant composition was prepared by blending, with respect to 100 mass % of the whole lubricant composition, 28.0 mass % of the copolymer from Polymerization Example 1 as the ethylene/α-olefin copolymer (B), 15.0 mass % of DIDA as the lubricant base oil (A), 6.5 mass % of the extreme pressure additive package (EP) and the balance of PAO-6 as an additional lubricant base oil (A).

Example 2

A lubricant composition was prepared in the same manner as in Example 1, except that the polymer 1 was replaced by 18.4 mass % of the polymer 2.

Example 3

A lubricant composition was prepared in the same manner as in Example 1, except that the polymer 1 was replaced by 17.0 mass % of the polymer 3.

Comparative Example 1

A lubricant composition was prepared in the same manner as in Example 1, except that the polymer 1 was replaced by 44.7 mass % of the polymer 4. The molecular weight of the lubricant composition obtained was measured. The GPC chart did not have any peaks in the range of 3,000 to 10,000 molecular weights. A maximum value that was probably assigned to the polymer 4 was observed at a molecular weight of 2,670. The weight fraction of components having a molecular weight not less than 20,000 was 0.06% as expressed relative to the components having a molecular weight not less than 2,670. This result is described in Table 2 as the "weight fraction of components having a molecular weight not less than 20,000".

Comparative Example 2

A lubricant composition was prepared in the same manner as in Example 1, except that the polymer 1 was replaced by 29.8 mass % of the polymer 5.

Comparative Example 3

A lubricant composition was prepared in the same manner as in Example 1, except that the polymer 1 was replaced by 14.2 mass % of the polymer 6.

Comparative Example 4

A lubricant composition was prepared in the same manner as in Example 1, except that the polymer 1 was replaced by 10.7 mass % of the polymer 7. The molecular weight of the lubricant composition obtained was measured. No peaks were observed in the range of 3,000 to 10,000 molecular weights. A maximum value that was probably assigned to the polymer 7 was observed at a molecular weight of 13,030. The weight fraction of components having a molecular weight not less than 20,000 was 44.07% as expressed relative to the components having a molecular weight not less than 13,030. This result is described in Table 2 as the "weight fraction of components having a molecular weight not less than 20,000".

Comparative Example 5

A lubricant composition was prepared in the same manner as in Example 1, except that the polymer 1 was replaced by 17.2 mass % of the polymer 8.

Comparative Example 6

A lubricant composition was prepared in the same manner as in Example 1, except that the polymer 1 which was the ethylene/α-olefin copolymer (B) was replaced by 30.7 mass % of PAO-100.

Comparative Example 7

A lubricant composition was prepared in the same manner as in Example 1, except that the polymer 1 which was the ethylene/α-olefin copolymer (B) was replaced by 35.6 mass % of mPAO-100.

Comparative Example 8

A lubricant composition was prepared in the same manner as in Example 1, except that the polymer 1 which was the ethylene/α-olefin copolymer (B) was replaced by 24.7 mass % of mPAO-300.

TABLE 2

| | | Ex. 1 | Ex. 2 | Ex. 3 | Comp. Ex. 1 | Comp. Ex. 2 | Comp. Ex. 3 |
|---|---|---|---|---|---|---|---|
| Polymer 1 | mass % | 28.0 | | | | | |
| Polymer 2 | mass % | | 18.4 | | | | |
| Polymer 3 | mass % | | | 17.0 | | | |
| Polymer 4 | mass % | | | | 44.7 | | |
| Polymer 5 | mass % | | | | | 29.8 | |
| Polymer 6 | mass % | | | | | | 14.2 |
| Polymer 7 | mass % | | | | | | |
| Polymer 8 | mass % | | | | | | |
| PAO-100 | mass % | | | | | | |
| mPAO-100 | mass % | | | | | | |
| mPAO-300 | mass % | | | | | | |
| PAO-6 | mass % | 50.5 | 60.1 | 61.5 | 33.8 | 48.7 | 64.3 |
| DIDA | mass % | 15.0 | 15.0 | 15.0 | 15.0 | 15.0 | 15.0 |
| EP | mass % | 6.5 | 6.5 | 6.5 | 6.5 | 6.5 | 6.5 |
| Molecular weight at peak top in the range of 3,000 to 10,000 molecular weights | — | 5,463 | 6,503 | 7,435 | Nil | 4,246 | 8,730 |
| Weight fraction of components having a molecular weight not less than 20,000 | % | 1.22 | 2.91 | 5.22 | 0.06 | 0.29 | 12.91 |
| Kinematic viscosity at 100° C. | $mm^2/s$ | 13.96 | 13.90 | 13.83 | 14.07 | 13.96 | 13.74 |
| Viscosity index | — | 157 | 162 | 164 | 152 | 156 | 167 |
| Viscosity at −40° C. | mPa · s | 38,000 | 35,000 | 33,000 | 65,000 | 45,000 | 30,000 |
| Viscosity after shear test | $mm^2/s$ | 13.78 | 13.66 | 13.54 | 14.03 | 13.79 | 12.70 |
| Rate of viscosity drop by shear test | % | 1.3 | 1.7 | 2.1 | 0.3 | 1.2 | 7.6 |

| | | Comp. Ex. 4 | Comp. Ex. 5 | Comp. Ex. 6 | Comp. Ex. 7 |
|---|---|---|---|---|---|
| Polymer 1 | mass % | | | | |
| Polymer 2 | mass % | | | | |
| Polymer 3 | mass % | | | | |
| Polymer 4 | mass % | | | | |
| Polymer 5 | mass % | | | | |
| Polymer 6 | mass % | | | | |
| Polymer 7 | mass % | 10.7 | | | |
| Polymer 8 | mass % | | 17.2 | | |
| PAO-100 | mass % | | | 30.7 | |
| mPAO-100 | mass % | | | | 35.6 |
| mPAO-300 | mass % | | | | |
| PAO-6 | mass % | 67.8 | 61.3 | 47.8 | 42.9 |
| DIDA | mass % | 15.0 | 15.0 | 15.0 | 15.0 |

TABLE 2-continued

| | | | | | |
|---|---|---|---|---|---|
| EP | mass % | 6.5 | 6.5 | 6.5 | 6.5 |
| Molecular weight at peak top in the range of 3,000 to 10,000 molecular weights | — | Nil | 6,846 | 4,698 | 5,562 |
| Weight fraction of components having a molecular weight not less than 20,000 | % | 44.07 | 13.00 | 0.20 | 0.20 |
| Kinematic viscosity at 100° C. | $mm^2/s$ | 14.22 | 13.92 | 13.99 | 13.97 |
| Viscosity index | — | 170 | 166 | 161 | 176 |
| Viscosity at −40° C. | mPa · s | 29,000 | 32,000 | 40,000 | 27,000 |
| Viscosity after shear test | $mm^2/s$ | 11.40 | 13.20 | 13.18 | 13.34 |
| Rate of viscosity drop by shear test | % | 19.8 | 5.2 | 5.8 | 4.5 |

In Examples 1 to 3, the Brookfield viscosity at −40° C. was below 40,000 mPa·s and the compositions attained excellent low-temperature viscosity characteristics as compared to Comparative Example 1 in which the peak top molecular weight of the ethylene/α-olefin copolymer was less than 3,000 and to Comparative Example 2 in which the peak top molecular weight of the ethylene/α-olefin copolymer was in the range of 3,000 to 10,000 but the weight fraction of components having a molecular weight not less than 20,000 in the lubricant composition was below 1%.

In Examples 1 to 3, the rate of viscosity drop by the 100-hour shear test was less than 3% and the compositions attained outstanding shear stability as compared to Comparative Example 4 in which the peak top molecular weight of the ethylene/α-olefin copolymer was above 10,000 and to Comparative Examples 3 and 5 in which the peak top molecular weight of the ethylene/α-olefin copolymer was in the range of 3,000 to 10,000 but the weight fraction of components having a molecular weight not less than 20,000 in the lubricant composition was greater than 10%. In particular, the comparison of Example 3 to Comparative Example 5 shows that despite the fact that the kinematic viscosities at 100° C. of the ethylene/α-olefin copolymers were substantially the same, significantly varied shear stabilities resulted due to the difference in the weight fraction of components having a molecular weight not less than 20,000.

Further, it has been shown that the use of a poly-α-olefin in place of the ethylene/α-olefin copolymer (B) results in a significant decrease in shear stability because of the α-olefin side chains being greatly affected by the shear stress.

Figure 2:
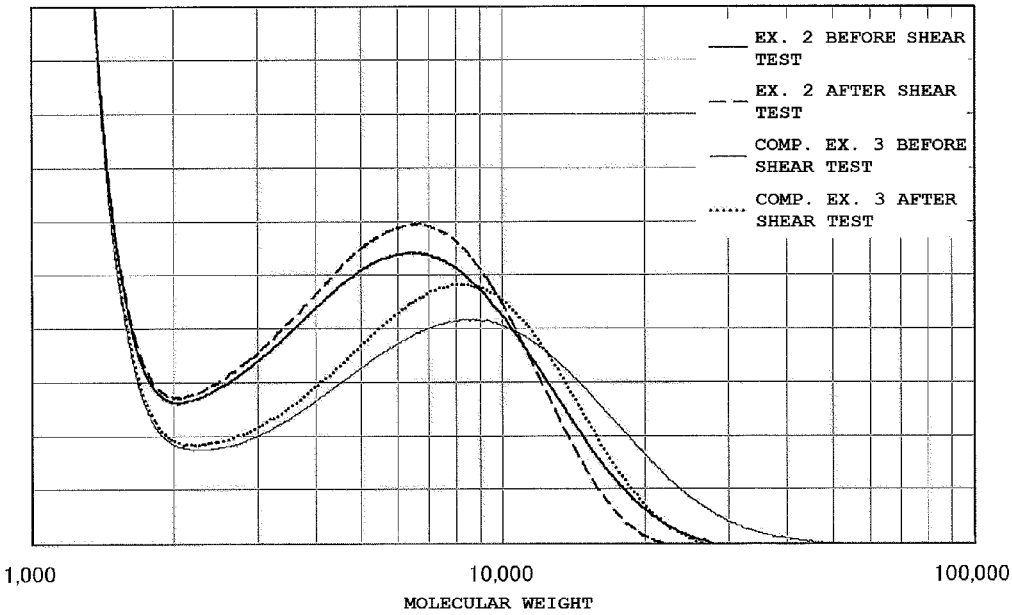
FIG. 2 is an enlarged view of the GPC charts in FIG. 1 where the molecular weight is around 10,000.

FIG. 1 and FIG. 2 show GPC charts of the lubricant compositions in Example 2 and Comparative Example 3 before (actual lines) and after (broken or dotted lines) the shear test. From the comparison of the charts, it has been shown that the components having a molecular weight not less than 20,000 were selectively broken into smaller molecules by the shear stress during the shear test.

The lubricant compositions of Comparative Examples 3 to 7 failed to satisfy the gear oil viscosity grade SAE 90 after the shear test. In order for these compositions to satisfy the grade after the shear test, the viscosity of the blend as prepared has to be increased to make up for the viscosity drop. This increase in viscosity leads to a deterioration in low-temperature viscosity characteristics. The lubricant compositions of the invention do not require such thickening and are highly advantageous in terms of fuel saving.

⟨Automotive Low-Viscosity Transmission Oils⟩

In Examples 4 to 6, the formulations were designed so that the kinematic viscosity at 100° C. would be about 6 $mm^2/s$. Table 3 sets forth the lubricant characteristics of the lubricant compositions obtained in Examples and Comparative Examples described below. The formulations here provide a viscosity suitably used for such lubricants as automotive manual transmission oils, automatic transmission oils, continuously variable transmission oils and dual clutch transmission oils.

Example 4

A lubricant composition was prepared by blending, with respect to 100 mass % of the whole lubricant composition, 13.5 mass % of the polymer 1 as the ethylene/α-olefin copolymer (B), 0.5 mass % of the pour-point depressant (PPD) and the balance of the mineral oil-A as the lubricant base oil (A).

Example 5

A lubricant composition was prepared in the same manner as in Example 4, except that the polymer 1 was replaced by 11.6 mass % of the polymer 2.

Example 6

A lubricant composition was prepared in the same manner as in Example 4, except that the polymer 1 was replaced by 10.4 mass % of the polymer 3.

Comparative Example 9

A lubricant composition was prepared in the same manner as in Example 4, except that the polymer 1 was replaced by 16.1 mass % of the polymer 5.

Comparative Example 10

A lubricant composition was prepared in the same manner as in Example 4, except that the polymer 1 was replaced by 9.3 mass % of the polymer 6.

Comparative Example 11

A lubricant composition was prepared in the same manner as in Example 4, except that the polymer 1 which was the ethylene/α-olefin copolymer (B) was replaced by 18.4 mass % of PAO-100.

Comparative Example 12

A lubricant composition was prepared in the same manner as in Example 4, except that the polymer 1 which was the ethylene/α-olefin copolymer (B) was replaced by 21.4 mass % of mPAO-100.

TABLE 3

| | | Ex. 4 | Ex. 5 | Ex. 6 | Comp. Ex. 9 | Comp. Ex. 10 | Comp. Ex. 11 | Comp. Ex. 12 |
|---|---|---|---|---|---|---|---|---|
| Polymer 1 | mass % | 13.5 | | | | | | |
| Polymer 2 | mass % | | 11.6 | | | | | |
| Polymer 3 | mass % | | | 10.4 | | | | |
| Polymer 5 | mass % | | | | 16.1 | | | |
| Polymer 6 | mass % | | | | | 9.3 | | |
| PAO-100 | mass % | | | | | | 18.4 | |
| mPAO-100 | mass % | | | | | | | 21.4 |
| PPD | mass % | 0.5 | 0.5 | 0.5 | 0.5 | 0.5 | 0.5 | 0.5 |
| Mineral oil-A | mass % | 86.0 | 87.9 | 89.1 | 83.4 | 90.2 | 81.1 | 78.1 |
| Molecular weight at peak top in the range of 3,000 to 10,000 molecular weights | — | 5,421 | 6,511 | 7,389 | 4,222 | 8,745 | 4,711 | 5,543 |
| Weight fraction of components having a molecular weight not less than 20,000 | % | 1.2 | 2.9 | 5.2 | 0.3 | 12.9 | 0.2 | 0.2 |
| Kinematic viscosity at 100° C. | $mm^2/s$ | 6.08 | 6.11 | 6.06 | 6.05 | 6.13 | 6.12 | 6.10 |
| Viscosity index | — | 161 | 162 | 164 | 159 | 166 | 159 | 173.8 |
| Viscosity at −40° C. | mPa · s | 9,800 | 9,500 | 9,400 | 10,200 | 9,200 | 10,000 | 8,800 |
| Rate of viscosity drop by shear test | % | <0.5 | <0.5 | 0.5 | <0.5 | 3.8 | 3.2 | 2.2 |

In Examples 4 to 6, the Brookfield viscosity at −40° C. was below 10,000 mPa·s and the compositions attained excellent low-temperature viscosity characteristics as compared to Comparative Example 9 in which the peak top molecular weight of the ethylene/α-olefin copolymer (B) was in the range of 3,000 to 10,000 but the weight fraction of components having a molecular weight not less than 20,000 in the lubricant composition was below 1%.

In the above lubricant compositions having a kinematic viscosity at 100° C. of not more than 7.5 $mm^2/s$, the rate of viscosity drop by the 100-hour shear test in Examples 4 to 6 was less than 1% and the compositions attained outstanding shear stability as compared to Comparative Example 10 in which the peak top molecular weight of the ethylene/α-olefin copolymer (B) was in the range of 3,000 to 10,000 but the weight fraction of components having a molecular weight not less than 20,000 in the lubricant composition was greater than 10%. That is, lubricants which do not substantially decrease viscosity under shear stress can be realized by the present invention.

Further, it has been shown that the use of a poly-α-olefin in place of the ethylene/α-olefin copolymer (B) results in a significant decrease in shear stability because of the α-olefin side chains being greatly affected by the shear stress.

Furthermore, the lubricant compositions of the invention can be designed with a lower viscosity as produced (initial viscosity) than conventional lubricants, and are also advantageous from the point of view of fuel efficiency.

When the extreme pressure additive package used in Example 1 is replaced by any of various additives, for example, an additive package for automatic transmission oils or continuously variable transmission oils which does not contain components having a molecular weight not less than 20,000, the lubricant compositions of the invent ion may be used as automatic transmission oils or continuously variable transmission oils that exhibit similar effects as obtained in Example 1.

The invention claimed is:

1. A lubricant composition comprising a lubricant base oil (A) having a kinematic viscosity at 100° C. of 1 to 10 $mm^2/s$, and an ethylene/α-olefin copolymer (B) having characteristics (B1) to (B4) described below, the lubricant composition having a kinematic viscosity at 100° C. of not more than 20 $mm^2/S$, the lubricant composition having a peak top of molecular weight in the range of 3,000 to 10,000 as measured by gel permeation chromatography (GPC) with reference to polystyrene standards, the lubricant composition having a weight fraction of components having a molecular weight not less than 20,000, measured with reference to polystyrene standards, of 1 to 10% relative to all components having a molecular weight not less than the molecular weight that gives the above peak top, (B1) the peak top molecular weight measured by gel permeation chromatography (GPC) with reference to polystyrene standards is 3,000 to 10,000, (B2) the copolymer shows no melting peak as measured on a differential scanning calorimeter (DSC), (B3) the value B represented by the equation [1] below is not less than 1.1

$$B = \frac{P_{OE}}{2P_O \cdot P_E} \quad [1]$$

wherein $P_E$ is the molar fraction of ethylene components, $P_O$ is the molar fraction of α-olefin components, and $P_{OE}$ is the molar fraction of ethylene-α-olefin sequences relative to all dyad sequences, (B4) the kinematic viscosity at 100° C. is 140 to 500 $mm^2/s$.

2. The lubricant composition according to claim 1, wherein the molar content of ethylene in the ethylene/α-olefin copolymer (B) is in the range of 30 to 70 mol %.

3. The lubricant composition according to claim 1, wherein the α-olefin in the ethylene/α-olefin copolymer (B) is propylene.

4. An automotive transmission oil comprising the lubricant composition described in claim 1, the lubricant composition having a kinematic viscosity at 100° C. of not more than 7.5 $mm^2/s$.

* * * * *